US012612214B2

(12) United States Patent
Ye et al.

(10) Patent No.: US 12,612,214 B2
(45) Date of Patent: Apr. 28, 2026

(54) COMPOSITE MULTI-FUNCTIONAL LOAD-BEARING PALLET

(71) Applicant: Microone Green Manufacturing Solution Co., Ltd, Jiaxing City (CN)

(72) Inventors: Zheng Ye, Jiaxing City (CN); Yongping Gong, Jiaxing City (CN); Mingsong Hao, Jiaxing City (CN); Shengrong Wei, Jiaxing City (CN); Jinbo Lou, Jiaxing City (CN); Shiyi Liu, Jiaxing City (CN); Weijie Zhang, Jiaxing City (CN)

(73) Assignee: MICROONE GREEN MANUFACTURING SOLUTION CO., LTD., Jiaxing City (CN)

( * ) Notice: Subject to any disclaimer, the term of this patent is extended or adjusted under 35 U.S.C. 154(b) by 188 days.

(21) Appl. No.: 18/437,203

(22) Filed: Feb. 8, 2024

(65) Prior Publication Data

US 2025/0178784 A1 Jun. 5, 2025

(30) Foreign Application Priority Data

Dec. 4, 2023 (CN) ..... 202311647981.4

(51) Int. Cl.
*B65D 19/44* (2006.01)
*B65D 19/38* (2006.01)

(52) U.S. Cl.
CPC ..... *B65D 19/44* (2013.01); *B65D 19/385* (2013.01); *B65D 2519/00815* (2013.01); *B65D 2519/0097* (2013.01)

(58) Field of Classification Search
CPC ..... B65D 19/44; B65D 19/385; B65D 2519/00815; B65D 2519/0097;
(Continued)

(56) References Cited

U.S. PATENT DOCUMENTS 2,844,344 A * 7/1958 Streb ..... B65D 19/385 108/53.5
3,160,120 A * 12/1964 Skubic ..... B65D 19/385 108/53.5
(Continued)

FOREIGN PATENT DOCUMENTS

CH 413723 A 5/1966
CN 101190726 A 6/2008
(Continued)

OTHER PUBLICATIONS

The State Intellectual Property Office of People's Republic of China, First Office Action and Cited References for Application No. 202311647981.4 and English Translation, Jun. 21, 2025.

*Primary Examiner* — Janet M Wilkens

(57) ABSTRACT

A composite multi-functional load-bearing pallet is provided, which relates to the technical field of load-bearing pallets. The composite multi-functional load-bearing pallet includes a pallet main body, support legs, a storage mechanism, and a limiting mechanism. The pallet main body has a plurality of support legs. The storage mechanism that limits a relative orientation between a load and the pallet main body is arranged between an upper end of the pallet main body and the support legs. The limiting mechanism that limits a relative orientation between adjacent pallet main bodies is arranged between the support legs and the pallet main body.

9 Claims, 18 Drawing Sheets

(58) Field of Classification Search
CPC ..... B65D 2519/00019; B65D 19/0075; B65D 2519/00024; B65D 2519/00029; B65D 2519/00034; B65D 2519/00044; B65D 2519/00059; B65D 2519/00268; B65D 2519/00273; B65D 2519/00293; B65D 2519/00308; B65D 2519/00323; B65D 2519/00338; B65D 2519/00502; B65D 2519/00512; B65D 2519/00562; B65D 2519/00587; B65D 2519/00641; B65D 2519/00661; B65D 2519/00676; B65D 2519/00696; B65D 2519/00781; B65D 2519/0096; B65D 19/0053; B65D 19/38; B65D 19/40; B65D 21/0212; B65D 2519/00955; B65D 2519/0098; B65D 2519/00333; B65D 2519/00094; B65D 21/0209
USPC ..... 108/53.1, 53.5, 55.1, 55.3, 57.16, 57.21, 108/57.22, 57.23, 57.24, 56.1, 57.29; 248/346.02; 206/386, 597, 600
See application file for complete search history.

(56) References Cited

U.S. PATENT DOCUMENTS 3,400,671 A * 9/1968 Erismann ..... B65D 19/40 108/53.5
3,842,534 A * 10/1974 Walters ..... A01G 18/62 108/53.5
4,838,178 A * 6/1989 Chriske ..... B65D 19/0026 108/55.1
4,915,033 A * 4/1990 Bond ..... B65D 19/44 108/55.1
4,977,836 A * 12/1990 Bond ..... B65D 19/44 248/346.02
5,533,456 A * 7/1996 Regina ..... B65D 19/385 211/183
6,192,807 B1 * 2/2001 Mason ..... B65D 19/0002 108/51.11
7,044,066 B1 * 5/2006 Miller ..... B65D 19/44 108/55.3
10,189,601 B2 * 1/2019 Grutt ..... B65D 19/40
2009/0211497 A1 8/2009 Koenes

FOREIGN PATENT DOCUMENTS

CN 102233966 A 11/2011
CN 203127310 U * 8/2013
CN 204916471 U * 12/2015
CN 207015767 U * 2/2018
CN 10525768 A 12/2019
CN 110525768 A 12/2019
CN 110589176 A 12/2019
CN 110525768 B 6/2021
CN 218752036 U 3/2023
DE 202007004669 U1 * 6/2007 ..... B65D 19/0095
EP 2163486 A2 * 3/2010 ..... B65D 19/385
EP 2733043 A2 1/2013
GB 780502 A 8/1957
WO WO-0078620 A1 * 12/2000 ..... B65D 19/0083

* cited by examiner

COMPOSITE MULTI-FUNCTIONAL LOAD-BEARING PALLET

CROSS-REFERENCE TO RELATED APPLICATION

This patent application claims the benefit and priority of Chinese Patent Application No. 2023116479814, entitled "COMPOSITE MULTI-FUNCTIONAL LOAD-BEARING PALLET" filed on Dec. 4, 2023, the disclosure of which is incorporated by reference herein in its entirety as part of the present application.

TECHNICAL FIELD

The present disclosure relates to the technical field of load-bearing pallets, and in particular, to a composite multi-functional load-bearing pallet.

BACKGROUND

Pallets are horizontal platform devices for containerizing, stacking, handling, and transporting placed cargoes and products serving as unit loads, which are unitized logistics appliances born to cooperate with efficient logistics. It can be said that the pallets are connecting points that run through various links of modern logistics systems. However, in the actual use, the pallets cannot be circulated and used in a logistics operation chain due to different specifications, and are only limited to internal use within enterprises. In addition, the existing pallets usually need to be stacked during storage. Usually, the pallets and the cargoes are limited and fixed in a direct contact stacking manner. There is a problem of separation and misalignment during moving and transporting.

In order to overcome disadvantages in a related technology, people have explored for a long time and proposed various solutions. For example, Chinese patent document 201010175319.X discloses a combined pallet, which consists of of three parts that are pallet laths, connecting pieces, and square pipes. Two sides of the square pipe are vertically connected with the upper and lower pallet laths at a spatial position through the connecting pieces. Clamping buckles that are distributed vertical to each other are arranged on upper and lower surfaces of the connecting piece. Clamping buckle grooves that are matched with the connecting pieces are arranged on upper and lower surfaces of the square pipe. Clamping buckle grooves that are matched with the connecting pieces are arranged on the pallet laths.

The above solution solves the problems of different specifications and poor adaptability to storage and transportation of the existing pallets to a certain extent. However, this solution still has a plurality of disadvantages, for example, problems, such as misalignment, are easily caused during storage, stacking, and transferring.

SUMMARY

The embodiments aim to provide a composite multi-functional load-bearing pallet, which solves problems existing in a related technology above, have the advantages of good structural stability, wide adaptability, and the like, and have good extension continuity.

To achieve the above objective, the present disclosure provides the following solution. The present disclosure provides a composite multi-functional load-bearing pallet, including:

a pallet main body, where the pallet main body comprises peripheral plates, top plates, and bottom plates, the peripheral plates are connected and fixed in sequence in an end to end manner to form a frame of the pallet main body, the bottom plates and the top plates are mounted on an inner side of the frame formed by the peripheral plates from bottom to top, and a plurality of support holes are formed in the top plates;

support legs, where the support legs are respectively arranged at corners of the pallet main body, each of the support legs comprises a main guide port and a support body that are connected integrally, an opening of the main guide port is upward and is positioned at a corner of the pallet main body, a bottom of the main guide port is communicated with the support body, and a bottom of the support body is closed through a cover plate, and the main guide port is funnel-shaped;

a storage mechanism, where the storage mechanism for limiting and storing cargoes is arranged on the pallet main body, the storage mechanism comprises support pipes and support rods, each of the support pipes is detachably inserted at the main guide port, and each of the support rods is detachably inserted in a corresponding one of the plurality of support holes; and a limiting mechanism, where the limiting mechanism is configured to limit a relative orientation of two adjacent pallet main bodies.

In some embodiments, multiple top plates may be laid side by side in the frame formed by the peripheral plates. Multiple support holes may be formed in each of the top plates. All of the multiple top plates may be in a same specification, and the support holes may be in one-to-one correspondence in position.

In some embodiments, the top plates and the bottom plates may be all C-shaped plates. Multiple vertical cylinders may be equidistantly distributed between the top plates and the bottom plates. The multiple vertical cylinders and the multiple support holes may be in one-to-one correspondence in position and may be communicated with each other.

In some embodiments, the main guide port may be formed by splicing and welding four pieces of trapezoidal plates. The main guide port may be configured to guide one of the support pipes or one of the support legs to be inserted. An upper port of the main guide port may be flush with the top plates of the pallet main body. The support body may be made of a rectangular pipe arranged vertically.

In some embodiments, a triangular plate for the support body to penetrate through may be fixed to each of corners of a bottom surface of the pallet main body. When two pallet main bodies may be extended continuously, sides of the two pallet main bodies at corresponding support legs at bottom surfaces of the two pallet main bodies may be connected by welding, and the triangular plates at the corresponding support legs at bottom surfaces of the two pallet main bodies may be connected by welding.

In some embodiments, a universal wheel may be mounted at a bottom of each of the support legs. Two cart rods may be inserted in upper ends of two adjacent support legs. The two cart rods may be connected to each other through a handrail.

In some embodiments, the limiting mechanism may include a first limiting component. The first limiting component may include a gasket fixed to a lower end of the support body. A notch for clamping the cover plate may be reserved in the bottom of the support body. The gasket may be fixed to a bottom of the cover plate. The gasket may be embedded in the main guide port of a lower pallet.

In some embodiments, the limiting mechanism may include a second limiting component. The second limiting component may include two limiting cross rods, main bases, limiting longitudinal rods, and auxiliary bases. The two limiting cross rods may be arranged in parallel at bottoms of short sides of the pallet main body. A bottom of each of the support legs at a corresponding one of the corners of the pallet main body may be inserted and fixed to a corresponding one of the main bases on a corresponding one of the two limiting cross rods. Two ends of the two limiting cross rods may be respectively connected through the limiting longitudinal rods. Each of the two limiting cross rods may be fixed inside a corresponding one of the auxiliary bases on a corresponding one of the limiting longitudinal rods.

In some embodiments, the limiting mechanism may include a third limiting component. The third limiting component may include upright rods, two shelf cross rods, and shelf longitudinal rods. A bottom end of each of the upright rods may be inserted in the main guide port. The two shelf cross rods may be arranged in parallel at tops of short sides of the pallet main body. A top end of each of the upright rods may be inserted and fixed inside a main rod seat on a corresponding one of the two shelf cross rods. Two ends of the two shelf cross rods may be respectively connected through the shelf longitudinal rods. An auxiliary rod seat for inserting the main rod seat may be arranged on a corresponding one of the shelf longitudinal rods. A shelf base may be inserted and fixed to an upper end of the auxiliary rod seat. An upper end of the shelf base may have a funnel-shaped auxiliary guide port for a corresponding one of the support legs of an upper pallet to insert.

Compared with the related technology, the embodiments achieve the following beneficial technical effects.

The composite multi-functional load-bearing pallet includes the pallet main body, the support legs, the storage mechanism, and the limiting mechanism. The pallet main body has multiple support legs. The storage mechanism that limits the relative orientation between a load and the pallet main body is arranged between the upper end of the pallet main body and the support legs. The limiting mechanism that limits a relative orientation between adjacent pallet main bodies is arranged between the support legs and the pallet main body. The adjacent pallet main bodies and the loads thereof are respectively provided with corresponding limiting structures, which ensures fixed positions of the loads during storage and transportation, and improves the stability of stacking pallet main bodies and bearing cargoes.

BRIEF DESCRIPTION OF THE DRAWINGS

To describe technical solutions in embodiments of the present disclosure or in a related technology more clearly, the following briefly describes the drawings required for describing the embodiments. Apparently, the drawings in the following description are merely some embodiments of the present disclosure, and those of ordinary skill in the art may still obtain other drawings from these drawings without creative efforts.

Figure 1:
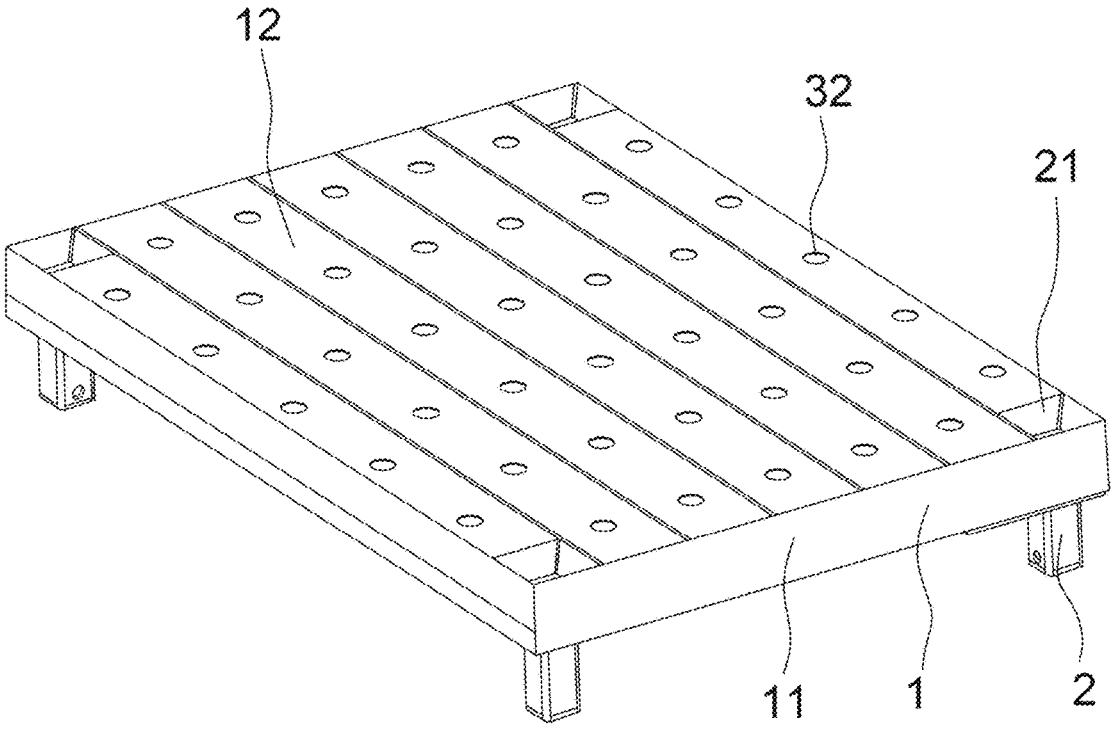
FIG. 1 is a schematic structural diagram according to the present disclosure.

List of the reference characters: 1 pallet main body; 11 peripheral plate; 12 top plate; 13 bottom plate; 14 triangular plate; 15 fixed base plate; 16 protective base plate; 2 support leg; 21 main guide port; 22 universal roller; 23 cart rod; 24 handrail; 25 handrail base; 3 storage mechanism; 31 support pipe; 32 support hole; 33 support rod; 4 first limiting component; 41 gasket; 5 second limiting component; 51 limiting cross rod; 52 main base; 53 limiting longitudinal rod; 54 auxiliary base; 6 third limiting component; 61 upright rod; 62 shelf cross rod; 63 main rod seat; 64 shelf longitudinal rod; 65 auxiliary rod seat; 66 shelf base; and 67 auxiliary guide port.

DETAILED DESCRIPTION OF THE EMBODIMENTS

Technical solutions in embodiments of the present disclosure will be clearly and completely described below with reference to drawings in the embodiments of the present disclosure. Apparently, the described embodiments are merely part rather than all of the embodiments of the present disclosure. On the basis of the embodiments of the present disclosure, all other embodiments obtained by those of ordinary skill in the art without creative work fall within the scope of protection of the present disclosure.

The embodiments aim to provide a composite multi-functional load-bearing pallet, which solves problems existing in the related technology above, have the advantages of good structural stability, wide adaptability, and the like, and have good extension continuity.

In order to make the above objective, features, and advantages of the present disclosure more apparent and more comprehensible, the present disclosure is further described in detail below with reference to the drawings and specific implementations.

Figure 2:
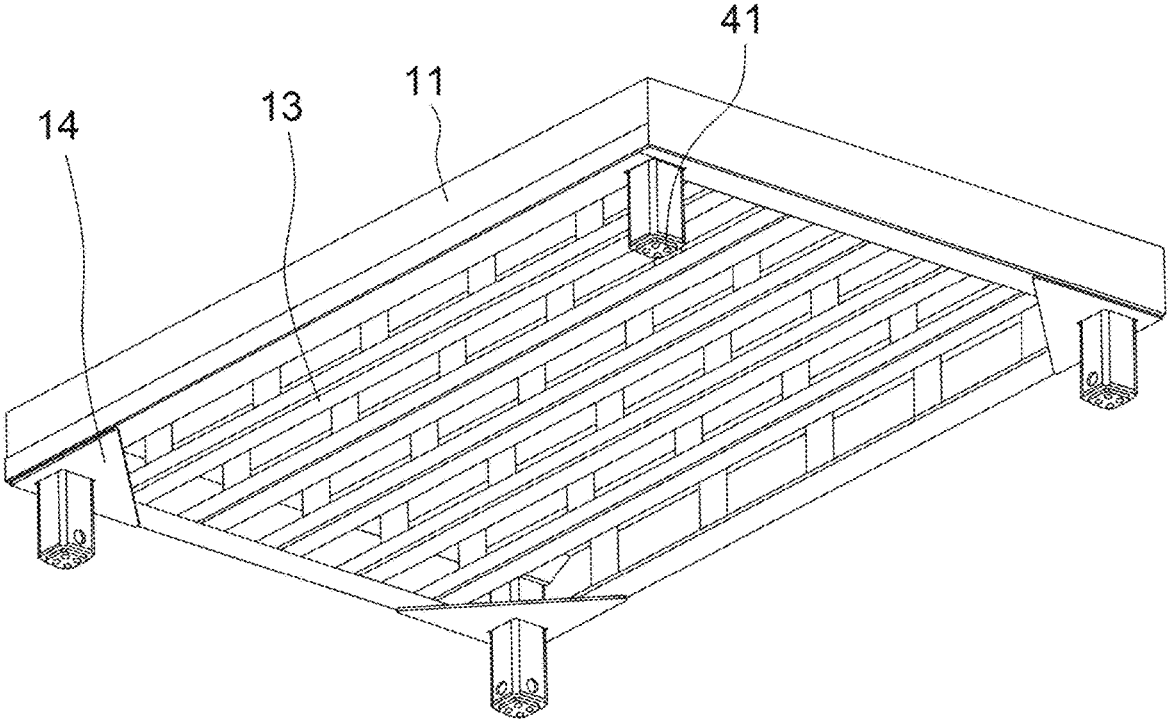
FIG. 2 is a schematic structural diagram according to the present disclosure from another perspective.

As shown in FIG. 1 to FIG. 38, the present disclosure provides a composite multi-functional load-bearing pallet, as shown in FIG. 1 and FIG. 2, including a pallet main body 1. The pallet main body 1 has multiple support legs 2. The support legs 2 keep a gap between a lower end of the pallet main body 1 and a horizontal plane, which facilitates transferring of a forklift or a cart. A storage mechanism 3 for limiting a relative orientation of a load and the pallet main body 1 is arranged between an upper end of the pallet main body 1 and the support leg 2. The storage mechanism 3 limits a horizontal position of the load relative to the pallet main body 1 to avoid slipping during storage and transferring. A limiting mechanism for limiting a relative orientation of adjacent pallet main bodies 1 is arranged between the support leg 2 and the upper end of the pallet main body 1. The limiting mechanism may be selected and mounted according to actual needs, thereby adapting to different environments.

Specifically, the support leg 2 is a rectangular pipe arranged vertically, which usually applies a square pipe and is fixed at a corner of the pallet main body 1. A lower end of the support leg 2 is closed by a cover plate. An upper end of the support leg 2 is connected to a funnel-shaped main guide port 21, and a port of the main guide port 21 is flush with the upper end of the pallet main body 1. The main guide port 21 is formed by splicing and welding multiple pieces of trapezoidal plates, and is configured to guide the support legs 2 to be inserted in each other for quickly positioning when the pallet main bodies 1 are stacked. The used main guide port 21 is mainly suitable for the limiting mechanism to realize quick insertion and fixation of various rod bodies.

Figure 3:
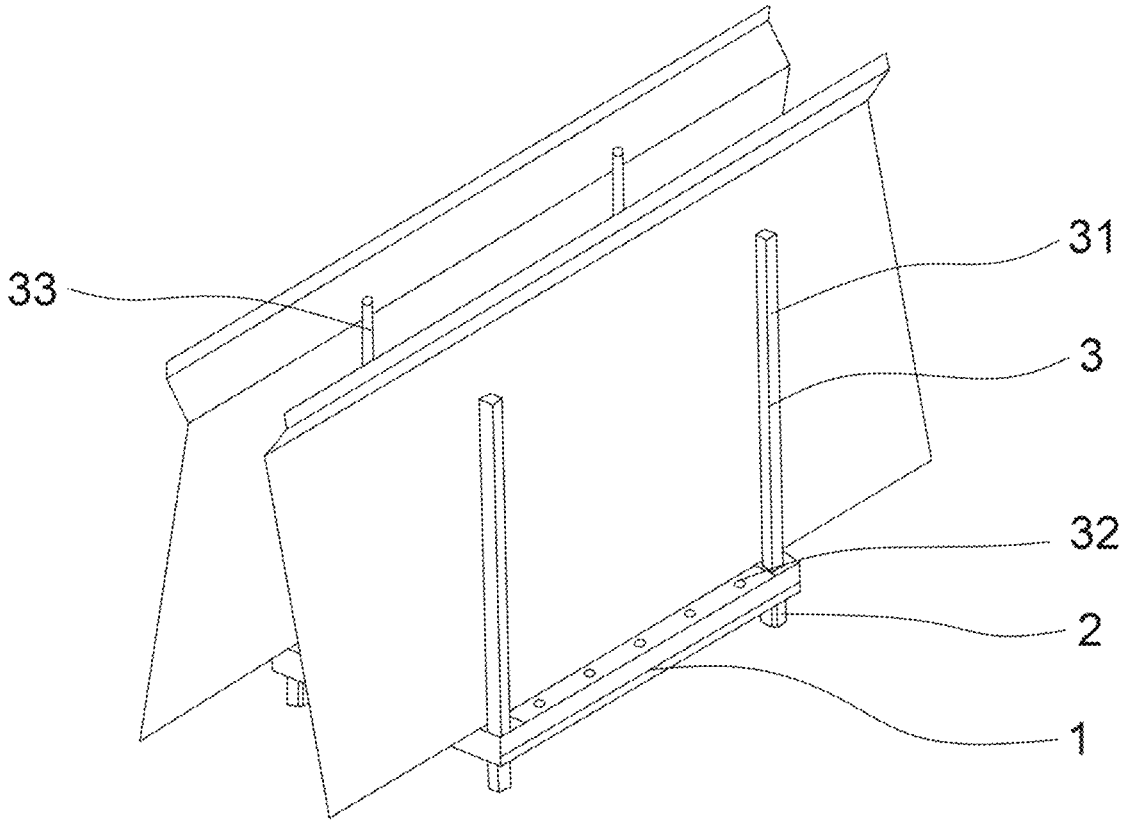
FIG. 3 is a schematic structural diagram of a storage mechanism according to the present disclosure.
Figure 4:
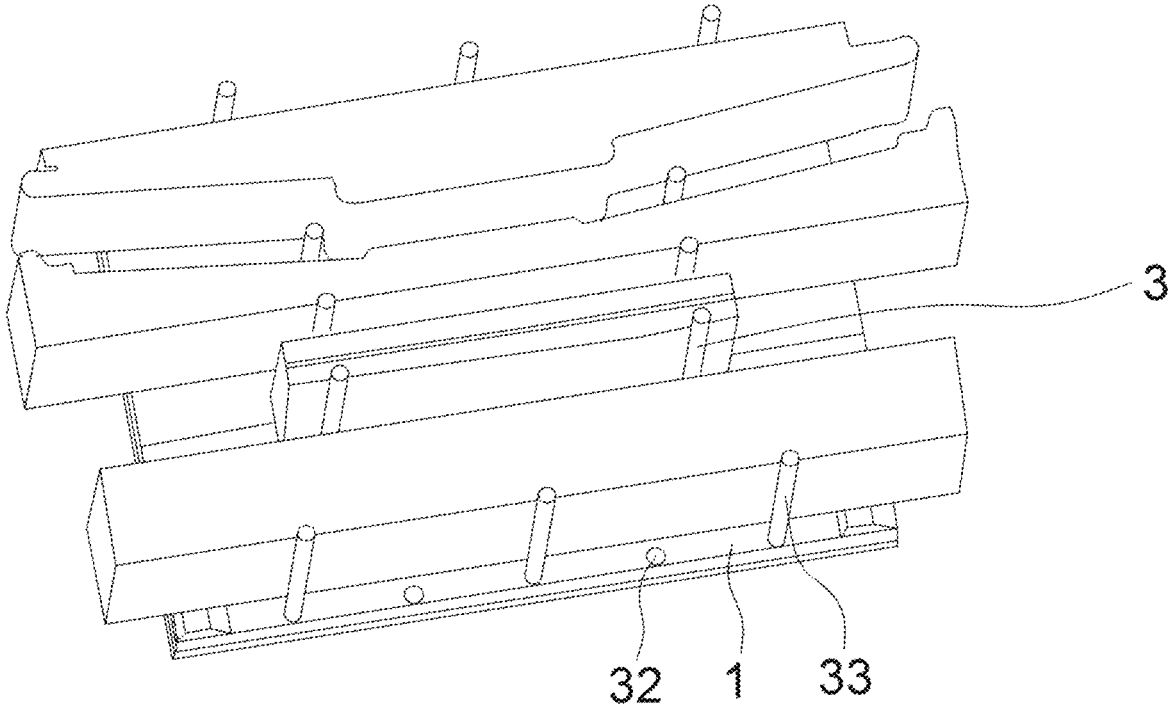
FIG. 4 is another schematic structural diagram of the storage mechanism according to the present disclosure.

As shown in FIGS. 3 and 4, when the loads are placed on the pallet main body 1, the storage mechanism 3 limits a horizontal orientation thereof. The storage mechanism 3 specifically includes support pipes 31 that are inserted and fixed to the support legs 2. The support pipe 31 is a rectangular pipe and fits and presses an inner side of the support leg 2. Support holes 32 arranged and distributed in a matrix are formed in the upper end of the pallet main body 1. Cylindrical support rods 33 are inserted and fixed or threaded to the support holes 32.

Figure 19:
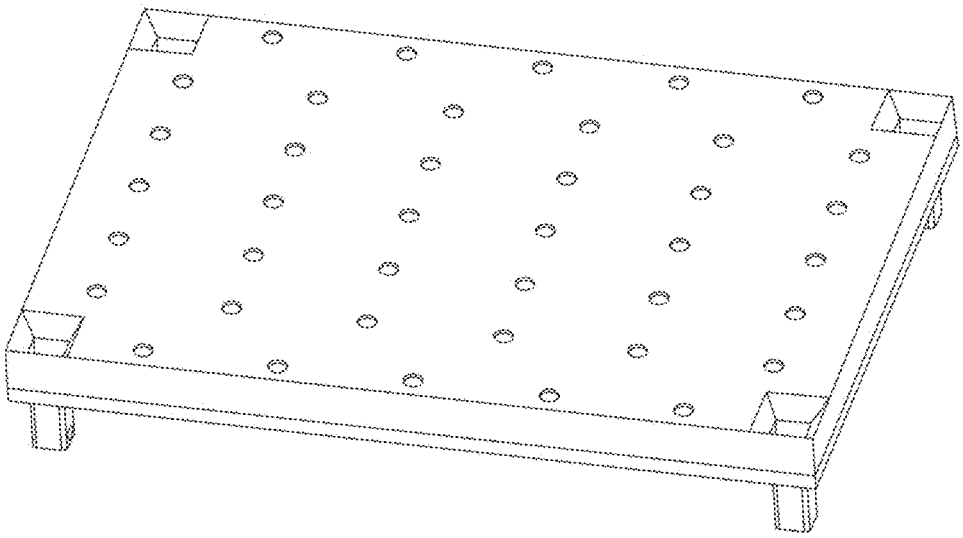
FIG. 19 is a schematic structural diagram of the pallet main body as a whole plate.
Figure 20:
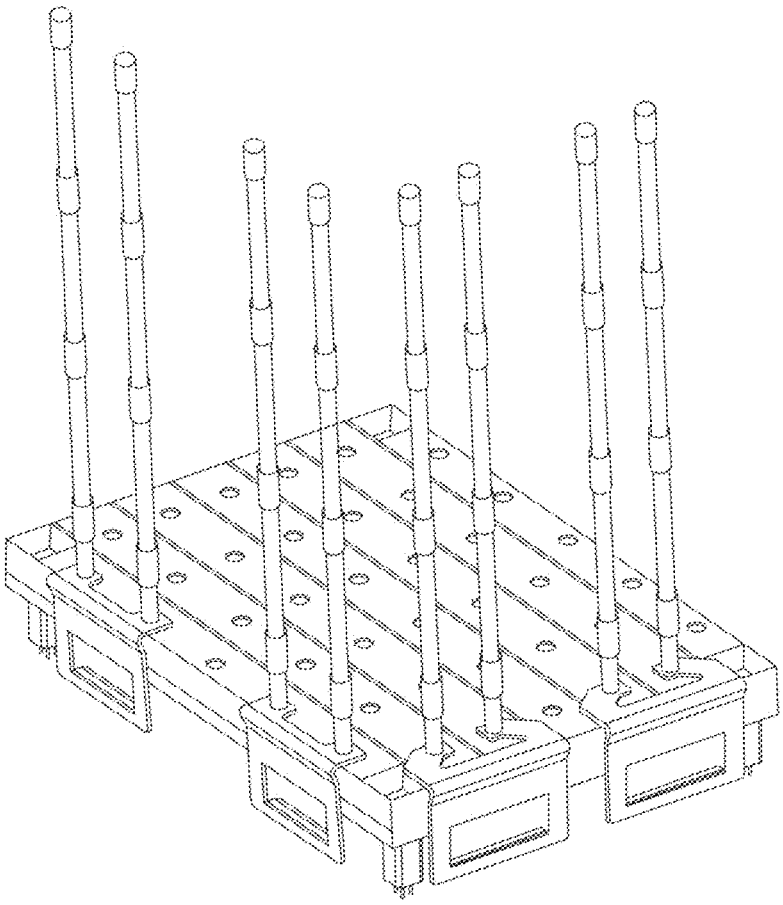
FIG. 20 is a schematic diagram of fixing pallet protection feet through insertion rods when insertion holes at edges of the pallet are not occupied.
Figure 21:
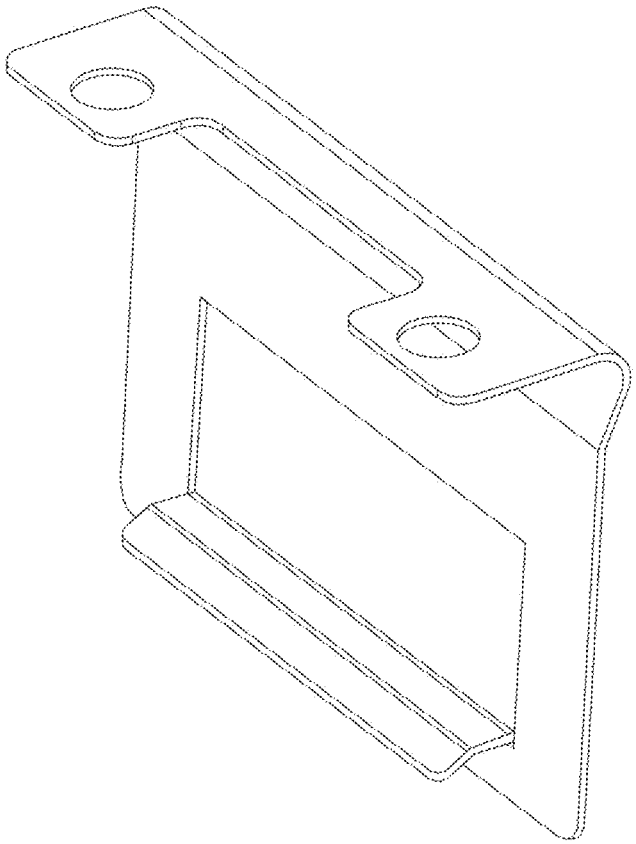
FIG. 21 is a schematic diagram of a pallet protection foot in a form I.
Figure 22:
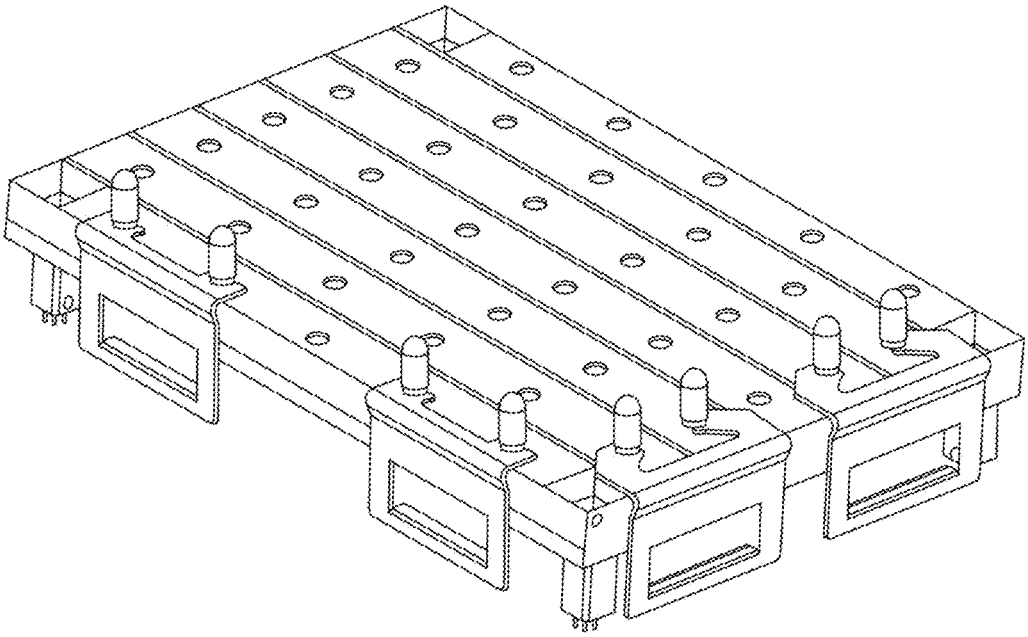
FIG. 22 is a diagram of a manner of mounting the pallet protection feet when the insertion holes at the edges of the pallet are not occupied and the insertion rods are not required.
Figure 23:
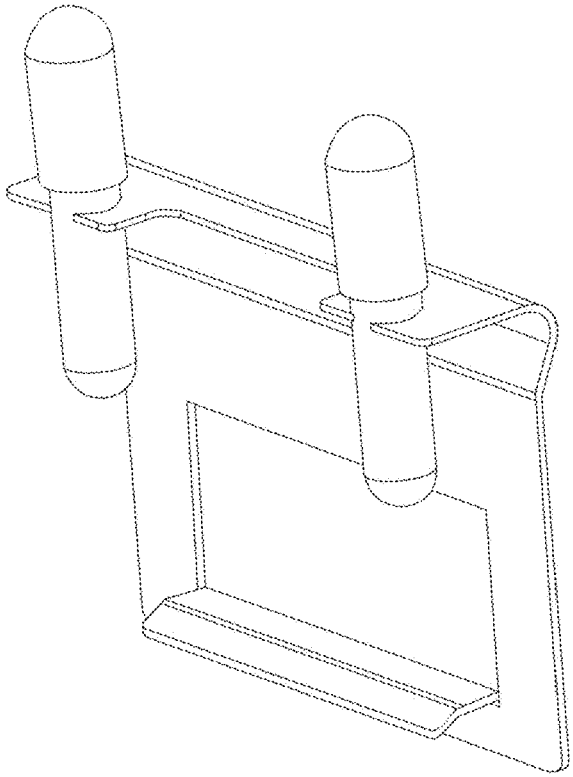
FIG. 23 is a schematic diagram of the pallet protection foot in the form I when the insertion holes at the edges of the pallet are not occupied and the insertion rods are not required.
Figure 24:
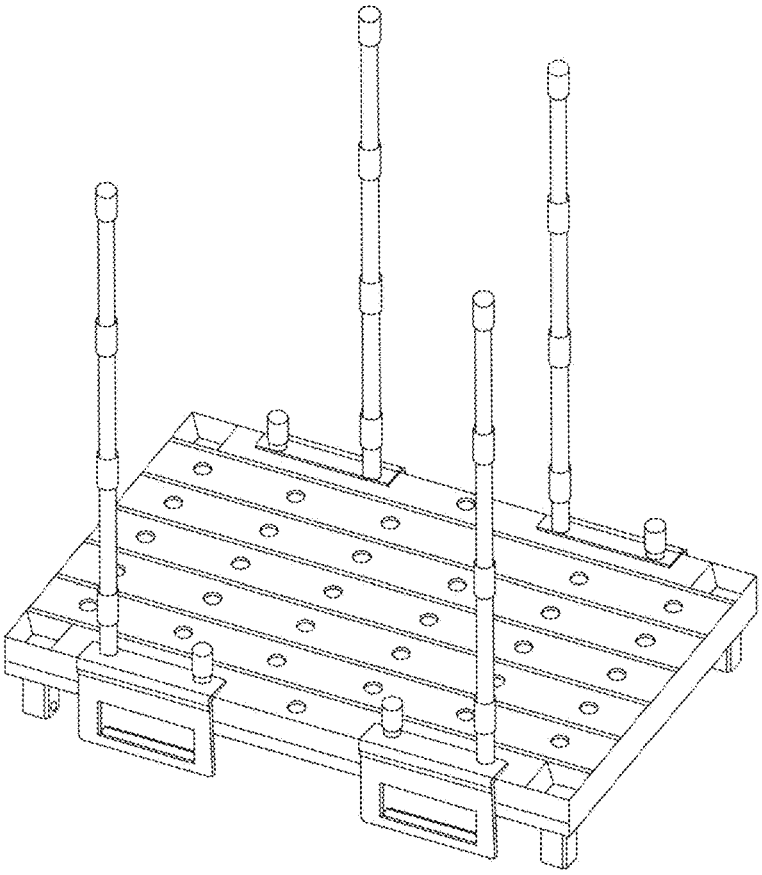
FIG. 24 is a schematic diagram of mounting the pallet protection feet when part insertion holes at the edges of the pallet are occupied by the insertion rods.
Figure 25:
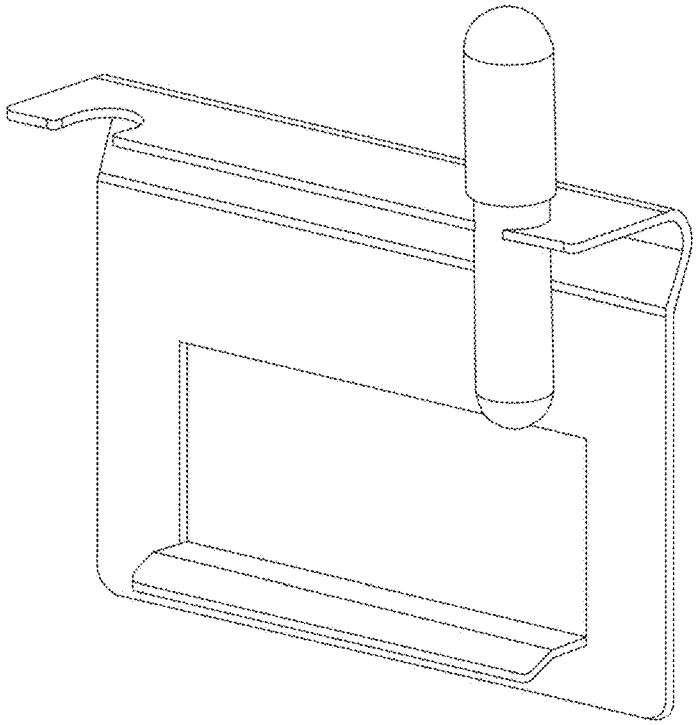
FIG. 25 is a schematic diagram of the pallet protection foot in the form I when part insertion holes at the edges of the pallet are occupied by the insertion rods.

As shown in FIG. 1 and FIG. 19, the pallet main body 1 may be formed by splicing multiple panels in the same specifications, or may also be prepared by applying an overall plate. When formed by splicing the panels in the same specifications, hole positions on the panels are consistent, which facilitates machining. During the actual use, the spliced panels or the overall panel may be selected according to requirements.

When regular loads such as box bodies are placed on the pallet main body 1, the support pipes 31 fixed at the corners of the pallet main body 1 can achieve a good limiting effect. When multiple groups of irregular loads are placed on the pallet main body 1, the support rods 33 are inserted and fixed by selecting suitable support holes 32 to limit the degree of freedom of the loads in a horizontal direction. The support pipes 31 may also be combined and stacked with another pallet main body 1 to realize multilayer storage of the loads.

Further, different from limiting the loads by the storage mechanism 3, the limiting mechanism in the present disclose is selected and mounted according to actual requirements to limit the positions between the pallet main bodies 1 and performs corresponding locking and fixing. The limiting mechanism includes a first limiting component 4 for limiting a relative direction of the pallet main bodies 1 that are adjacently stacked up and down; or a second limiting component 5 is arranged between the pallet main bodies 1 that are adjacently arranged left and right for limiting the relative orientation thereof; or the pallet main bodies 1 are stacked up and down through a third limiting component 6 to form a frame structure.

Figure 5:
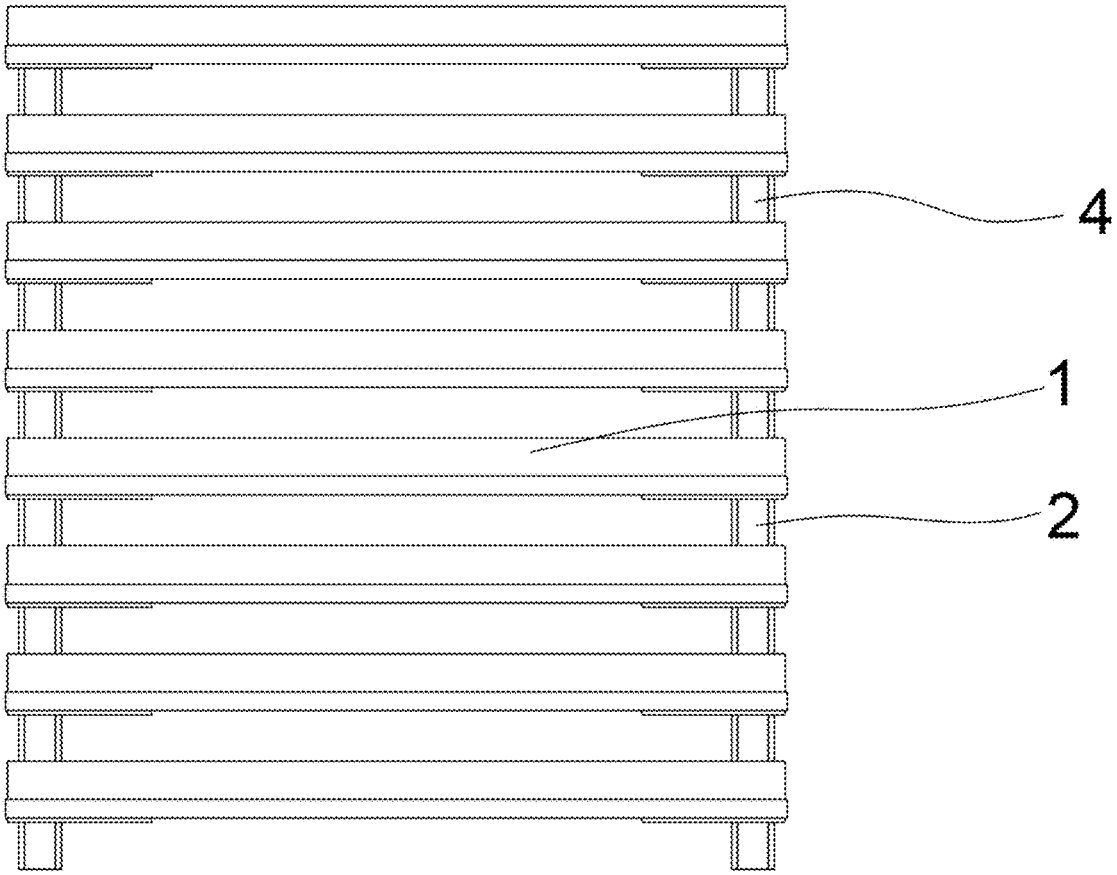
FIG. 5 is a schematic structural diagram of a first limiting component according to the present disclosure.

As shown in FIG. 2 and FIG. 5, the first limiting component 4 includes a gasket 41 fixed to a lower end of the support leg 2 of the pallet main body 1. The gasket 41 is fixedly connected to the cover plate at a bottom of the support leg 2 in a manner such as riveting. A notch for clamping the cover plate is reserved in the lower end of the support leg 2. The gasket 41 is embedded with an opening of the upper end of the support leg 2 of another pallet main body 1 to avoid loosening. The support legs 2 of the pallet main bodies 1 that are adjacently stacked up and down are in one-to-one correspondence in a vertical direction. The specifications of various pallet main bodies 1 are kept consistent. After stacking, the support legs 2 may still maintain relative separation of the pallet main bodies 1.

As shown in FIGS. 1 and 2, the pallet main body 1 is usually made of a stainless steel material or an aluminum profile, and specifically includes peripheral plates 11 distributed in a circumferential direction. The peripheral plates 11 are fixed by welding transverse plates and longitudinal plates and are fitted with corresponding reinforcement plates. The upper end of the pallet main body 1 is closed by multiple top plates 12 that are adjacently arranged. Various top plates 12 fit tightly, and two ends of the top plate 12 are welded and fixed to the peripheral plates 11. Bottom plates 13 that are in one-to-one correspondence with the top plates 12 are arranged at the lower end of the pallet main body 1 to achieve a bearing effect. The top plates 12 and the bottom plates 13 are C-shaped plates. Multiple vertical cylinders are equidistantly distributed between the top plate and the bottom plate.

Figure 11:
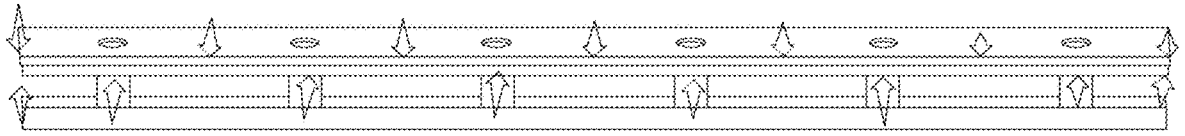
FIG. 11 is a connection and stress diagram of a top plate and a bottom plate.
Figure 12:
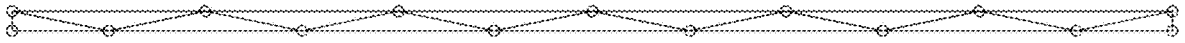
FIG. 12 is a diagram of stress nodes of the top plate and the bottom plate.

As shown in FIG. 11, the top plates 12 and the bottom plates 13 are C-shaped folded edges, and are welded to form a truss structure. A direction indicated by an arrow is a stress direction. In FIG. 12, dots represent welding positions of the top plates 12 and the bottom plates 13. Each welding position serves as a stress node, which transfers a force to an adjacent node through a steel plate, and finally, transfers the force to plate surfaces on two sides of the pallet main body 1.

Figure 13:
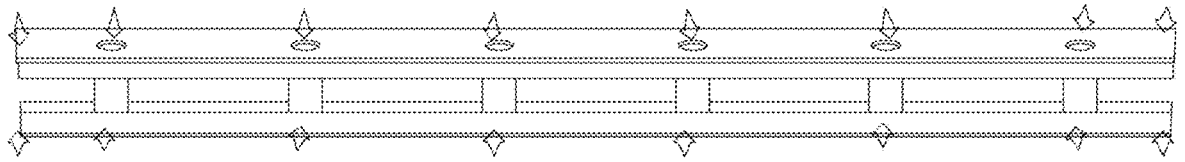
FIG. 13 is a connection and stress diagram of vertical cylinders.
Figure 14:
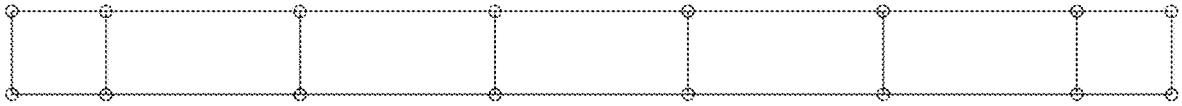
FIG. 14 is a diagram of stress nodes of the vertical cylinders.

Further, as shown in FIG. 13 and FIG. 14, vertical cylinders are equidistantly distributed between the top plate 12 and the bottom plate 13. The vertical cylinders are in one-to-one correspondence with the support holes 32 in the storage mechanism 3, and are configured to insert and fix the support rods 33. After the vertical cylinders are welded with the top plates 12 and the bottom plates 13, the truss structure in FIG. 13 is formed. Dots in FIG. 14 represent welding positions. Each welding position serves as a stress node, which transfers a force to an adjacent node through a steel plate, and finally, transfers the force to plate surfaces on two sides of the pallet main body 1.

Figure 15:
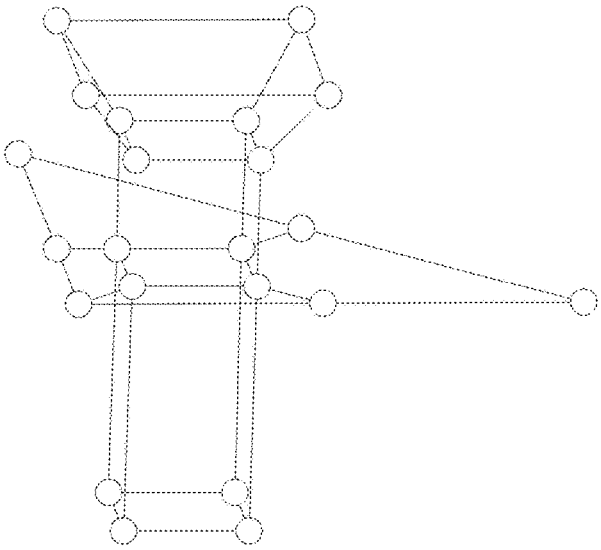
FIG. 15 is a diagram of stress nodes at a support leg.

As shown in FIG. 2 and FIG. 15, triangular plates 14 for the support legs 2 to penetrate through are fixed to corners of the lower end of the pallet main body 1. The triangular plates 14 locally strengthen the pallet main body 1 and increase welding points between the pallet main body 1 and the support legs 2. A thick-walled square pipe of the support leg 2, the funnel-shaped main guide port 21, and the triangular plate 14 are welded to form a support leg. As shown in FIG. 15, dots represent stress nodes around the support leg. This structure bears loads in layers, so that the support legs 2 are more stable and can bear a heavy load.

Figure 16:
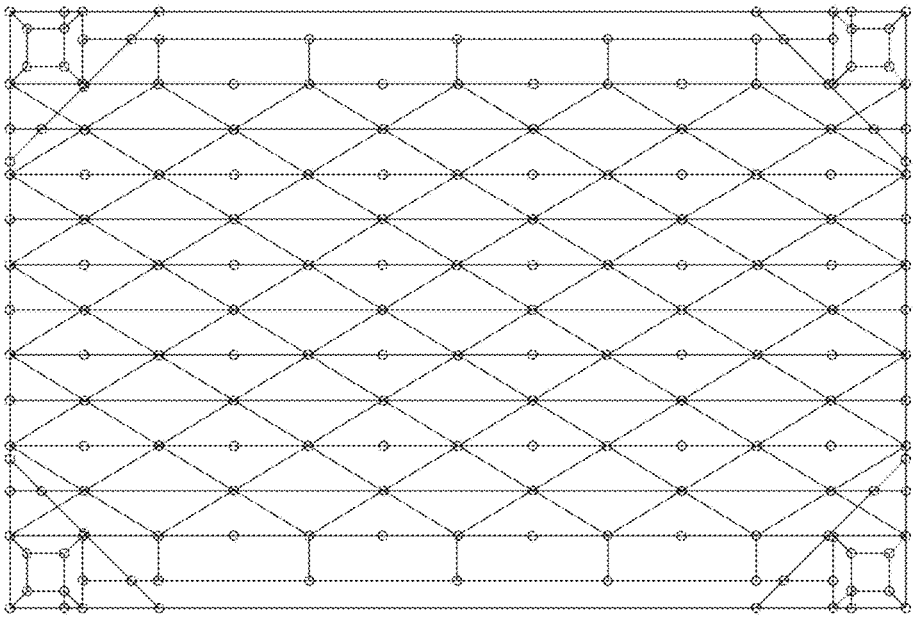
FIG. 16 is a vertical view of a total stress node diagram of a composite multi-functional load-bearing pallet.
Figure 17:
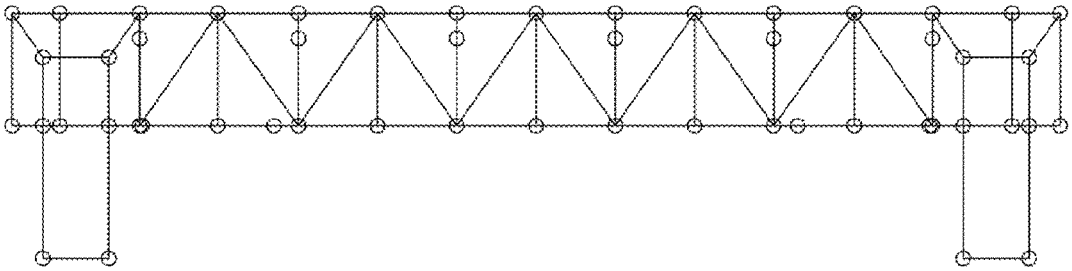
FIG. 17 is a side view of the total stress node diagram of the composite multi-functional load-bearing pallet.
Figure 18:
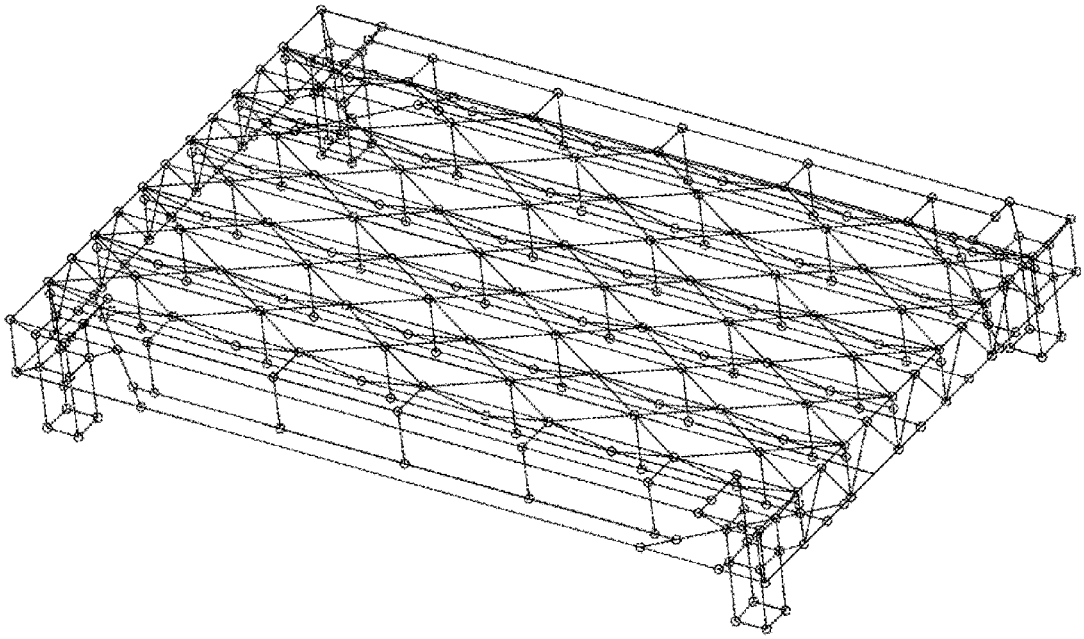
FIG. 18 is three-dimensional diagram of the total stress node diagram of the composite multi-functional load-bearing pallet.

The above node stress diagram forms a total stress node diagram of a pallet. The total stress node diagrams of the pallet are as shown in FIGS. 16 to 18. After the vertical cylinders are welded with the top plates 12 and the bottom plates 13, the truss structure is formed. The top plates 12 and the bottom plates 13 are C-shaped folded edges, and are welded to form the truss structure. The thick-walled square pipe of the support leg 2, the funnel-shaped main guide port 21, and the triangular plate 14 form a closed loop stressed truss structure. A force applied to the surface of the pallet is uniformly dispersed to four support legs 2 of the pallet.

Figure 9:
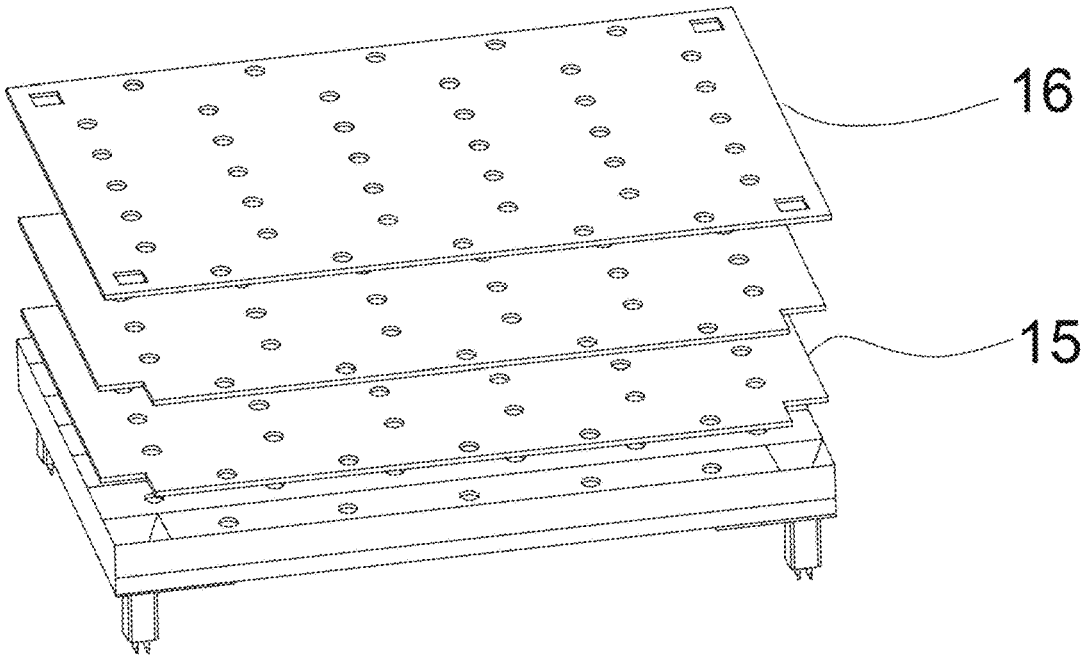
FIG. 9 is a structural diagram of base plates of a pallet main body according to the present disclosure.

It can be seen from FIG. 9 that fixed base plates 15 and a protective base plate 16 are laid at the upper end of the pallet main body 1 in sequence. The fixed base plate 15 may be made of a hard plate such as a wood plate, a wear-resistant plastic plate, and a Polypropylene (PP) plate. The number of layers of the fixed base plates 15 may be increased or decreased according to requirements. The protective base plate 16 is made of a soft plate such as Expanded Polyethylene (EPE) foam and corrugated paper. Notches opposite to the support legs 2 are respectively formed at corners of the fixed base plates 15 and the protective base plate 16, which do not affect the insertion and fixation of the storage mechanism 3 and the limiting mechanism of the pallet main body 1.

Embodiment II

Figure 6:
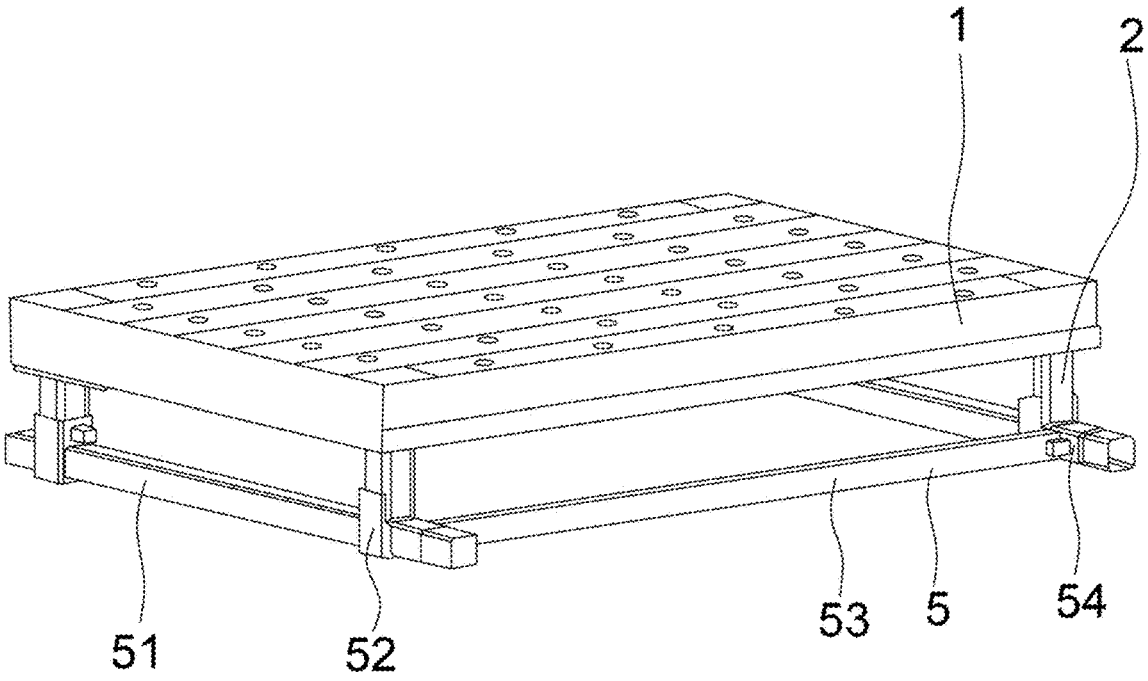
FIG. 6 is a schematic structural diagram of a second limiting component according to the present disclosure.

As shown in FIG. 6, structures, principles, and implementation steps of the present embodiment are similar to those of Embodiment I. The difference is that the present embodiment applies the second limiting component 5 to achieve relative limitation of the pallet main bodies 1 that are adjacently arranged left and right. The upper ends of the pallet main bodies 1 are ensured to be flush through the second limiting component 5, which is suitable for placing a load with a larger volume.

The second limiting component 5 includes limiting cross rods 51 arranged horizontally. The limiting cross rods 51 are usually relatively parallel to short sides of the pallet main body 1. The limiting cross rod 51 has a main base 52 opposite to the support leg 2. An upper end of the main base 52 is inserted and fixed to the support leg 2. The limiting cross rod 51 is positioned below the pallet main body 1. The main base 52 usually directly fits the ground. The support leg 2 is locked and fixed to the main base 52 of the limiting cross rod 51 through a threaded piece or a pin shaft. A corresponding pin hole is formed in a side surface of the lower end of the support leg 2. The main base 52 has a socket for mounting the threaded piece or the pin shaft.

A limiting longitudinal rod 53 that is arranged vertically relative to the limiting cross rods 51 is connected between ends of the limiting cross rods 51. The limiting longitudinal rod 53 is relatively parallel to a long side of the pallet main body 1 and has an auxiliary base 54 for the end of the limiting cross rod 51 to insert. The auxiliary base 54 is inserted and fixed to the end of the other limiting cross rod 51. The limiting cross rod 51 is locked and fixed to the auxiliary base 54 of the limiting longitudinal rod 53 through a threaded piece or a pin shaft. The limiting cross rods 51 are connected one by one through the limiting longitudinal rods 53 and the auxiliary bases 54, so that the pallet main bodies 1 are connected into a long strip shape, which is suitable for storing a load with a large volume.

Embodiment III

Figure 7:
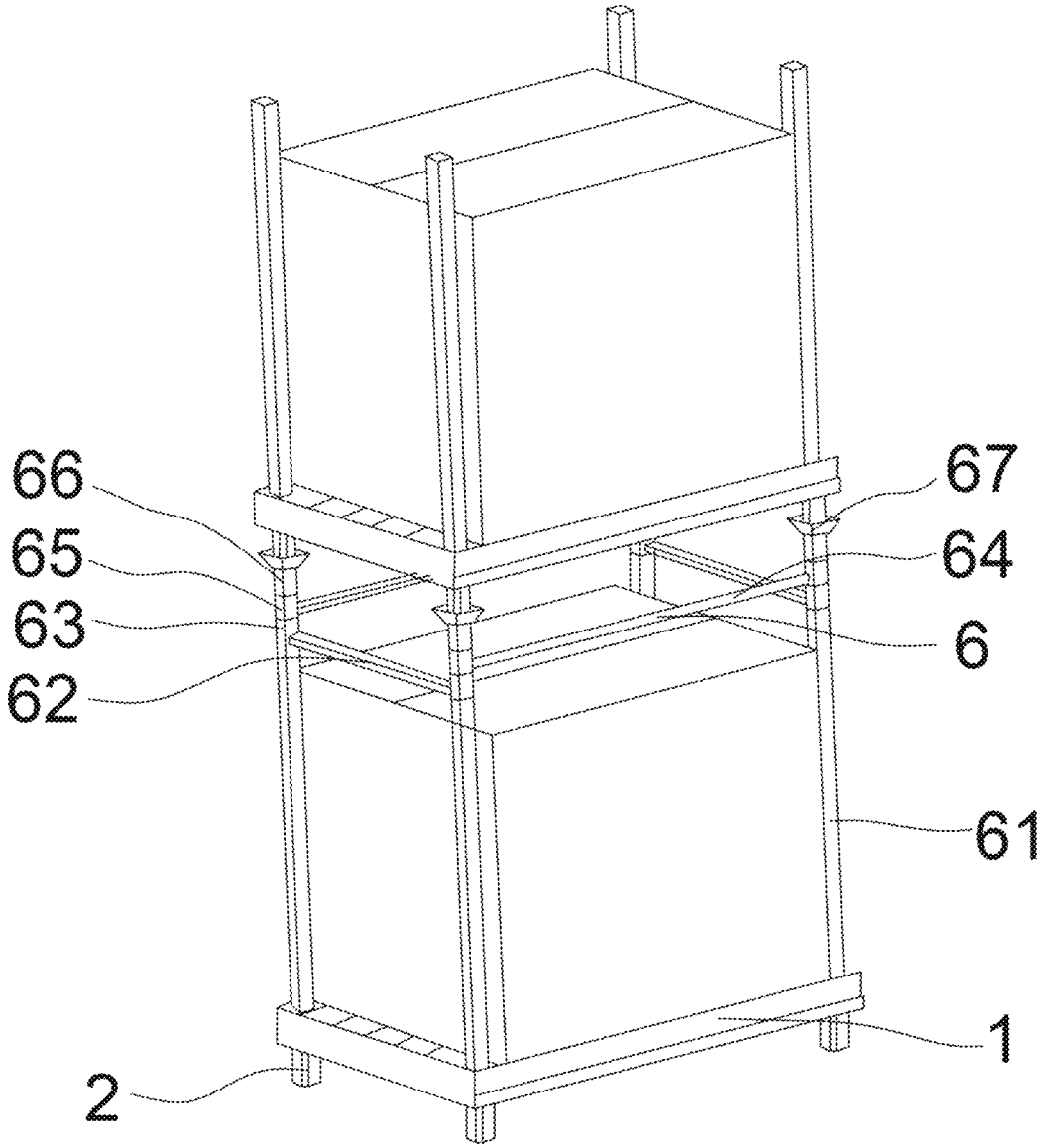
FIG. 7 is a schematic structural diagram of a third limiting component according to the present disclosure.

As shown in FIG. 7, structures, principles, and implementation steps of the present embodiment are similar to those of Embodiment I. The difference is that the present embodiment applies the third limiting component 6 to combine the pallet main bodies 1 into a frame structure, which matches the storage mechanism 3 to achieve three-dimensional storage of multiple loads.

The third limiting component 6 includes upright rods 61 that are vertically inserted in the support legs 2. The upright rods 61 may also be directly replaced by the support pipes 31 in the storage mechanism 3. A shelf cross rod 62 is connected between top ends of the upright rods 61. The shelf cross rod 62 has a main rod seat 63 for a top end of the upright rod 61 to insert and fix. A shelf longitudinal rod 64 is connected between ends of the shelf cross rods 62. The shelf longitudinal rod 64 has an auxiliary rod seat 65 for the main rod seat 63 to insert and fix. The shelf cross rods 62 and the shelf longitudinal rods 64 are combined into a frame structure, and form a frame body structure with the upright rods 61 positioned below and the pallet main body 1. A shelf base 66 is additionally inserted and fixed to an upper end of the auxiliary rod seat 65. An upper end of the shelf base 66 has a funnel-shaped auxiliary guide port 67 for the support leg 2 of the another pallet main body 1 to insert. Multiple frame body structures are combined through the shelf bases 66, so as to realize three-dimensional storage of cargoes.

Embodiment IV

Figure 8:
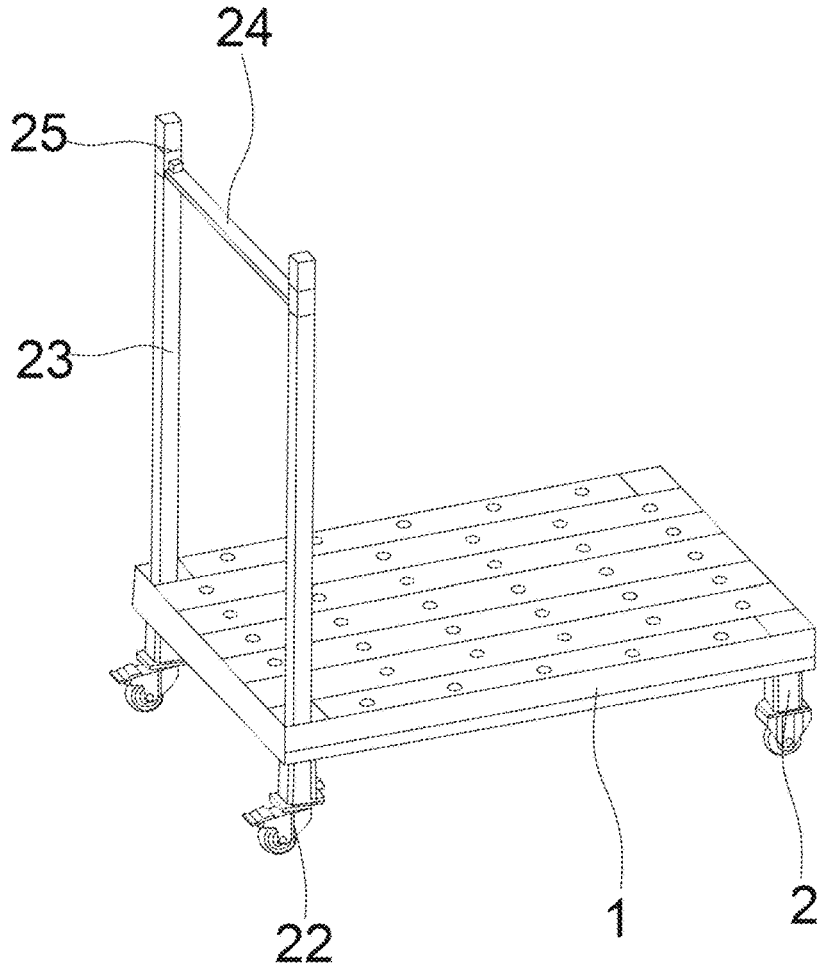
FIG. 8 is a schematic structural diagram of a cart according to the present disclosure.

As shown in FIG. 8, structures, principles, and implementation steps of the present embodiment are similar to those of Embodiment I. The difference is that universal wheels 22 are respectively fixed to lower ends of the support legs 2 of the pallet main body 1 in the present embodiment. Cart rods 23 are inserted and fixed to upper ends of the support legs 2. The cart rods 23 may also be replaced by the support pipes 31. Handrails 24 are connected between the upper ends of the cart rods 23 to form a rectangular frame body. The handrail 24 has a handrail base 25 for the cart rod 23 to insert and fix. An operator can directly push the pallet main body 1 to move, which improves the transfer flexibility of the cargoes.

Embodiment V

Figure 10:
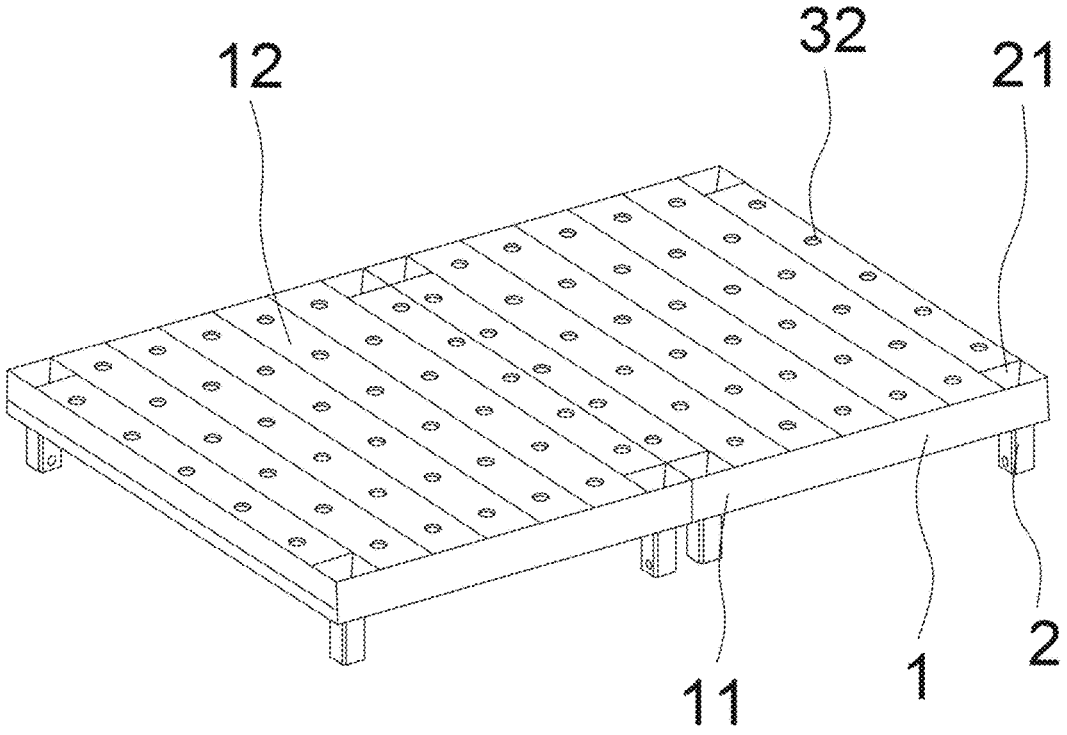
FIG. 10 is a schematic diagram of welding pallet main bodies according to the present disclosure.

As shown in FIG. 10, structures, principles, and implementation steps of the present embodiment are similar to those of Embodiment I. The difference is that the main guide ports 21 of the pallet main body 1 and the triangular plates 14 connected to the support legs 2 are respectively welded and fixed to the main guide ports 21 of another pallet main body 1 and the triangular plates 14. Multiple pallet main bodies 1 are spliced and welded together in different directions, which can bear a larger load and an object with a larger size.

The support legs 2, the triangular plates 14, and the main guide ports 21 are all welded and fixed by using thick plates of 4 mm. The load-bearing capacity of the pallet main body 1 will not decrease due to the increase of the size. The adaptability of the pallet main body 1 is improved due to the expansion of bearing area.

In conclusion, the principle of the present embodiment is that: after loads are placed at the upper end of the pallet main body 1, the storage mechanism 3 realizes multi-point limitation in a horizontal direction in a manner of inserting pipes. The limiting component locks and limits when the pallet main bodies 1 are arranged vertically or horizontally, so as to expand the load-bearing capacity of the pallet or reduce the space required for the storage of the pallet. The stability of the pallet main body 1 and the loads thereof during storage and transporting is ensured through the cooperation of the limiting component and the pallet main body 1.

Embodiment VI

As shown in FIGS. 20 to 32, pallet protection feet are also arranged on a periphery of the pallet main body in the present embodiment. There are multiple forms of the pallet protection feet.

FIGS. 20 to 25 show a pallet protection foot in form I. When insertion holes at edges of the pallet are not occupied, the pallet protection feet may be fixed by applying the insertion rods shown in FIG. 20. When insertion holes at edges of the pallet are not occupied and the insertion rods are not required, the pallet protection feet are mounted in a manner shown in FIG. 22. When part insertion holes at edges of the pallet are occupied, the pallet protection feet are mounted in a manner shown in FIG. 24.

Figure 26:
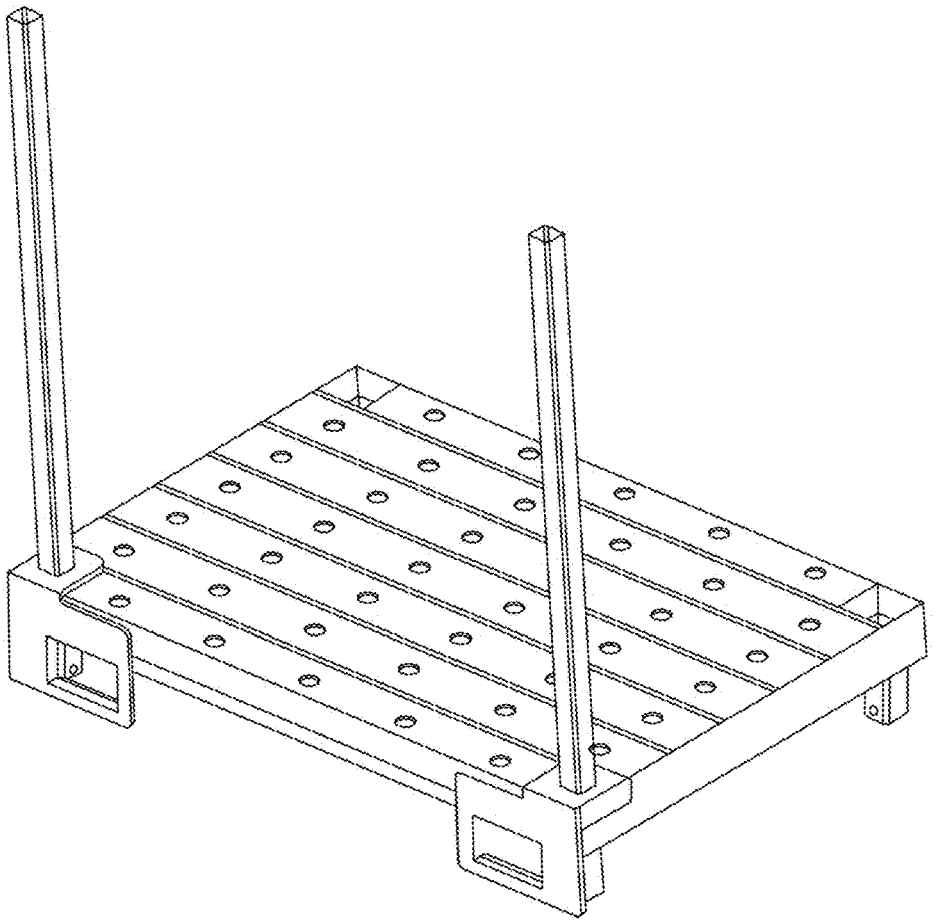
FIG. 26 is a schematic diagram I of fixing the pallet protection feet by using upright columns at four corners.
Figure 27:
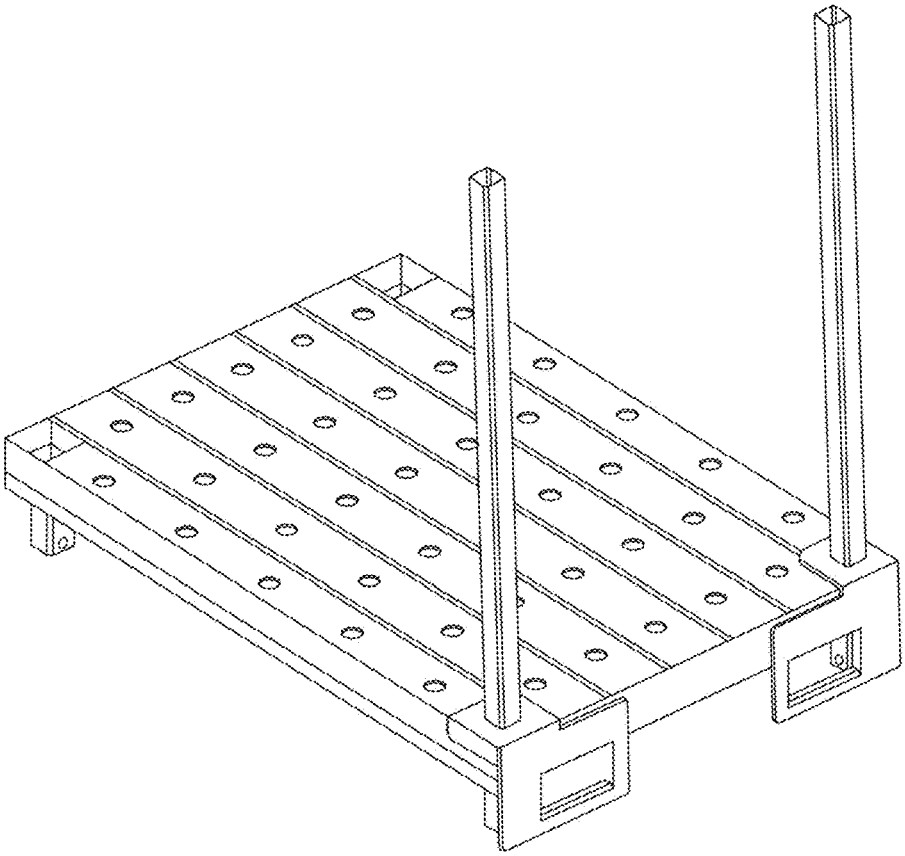
FIG. 27 is a schematic diagram II of fixing the pallet protection feet by using upright columns at four corners.
Figure 28:
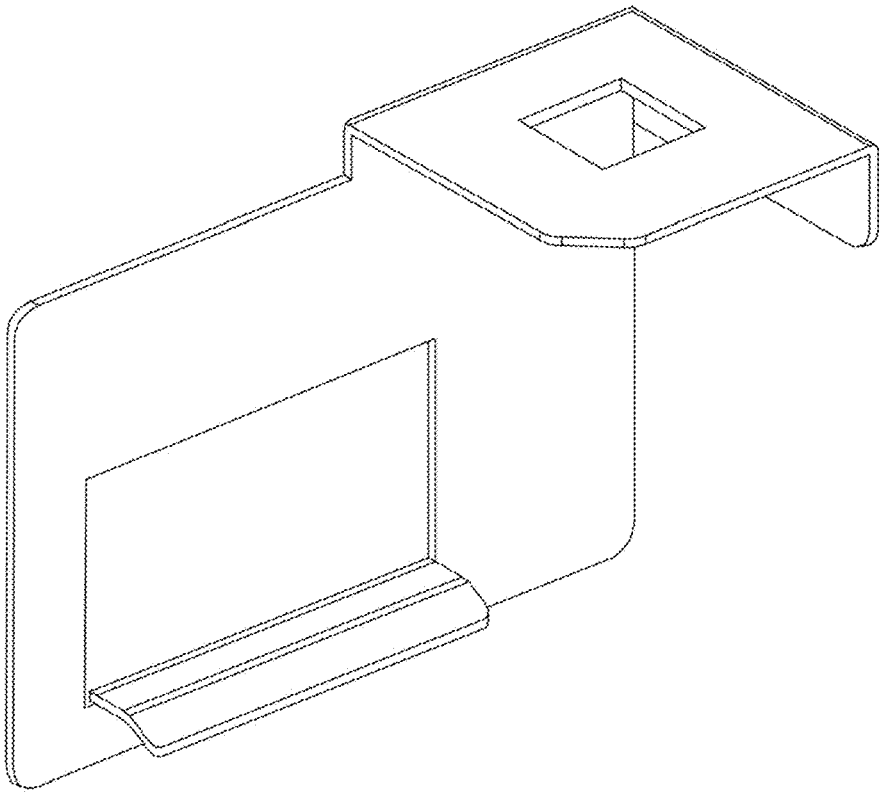
FIG. 28 is a schematic diagram of a pallet protection feet in a form II in FIG. 26 and FIG. 27.
Figure 29:
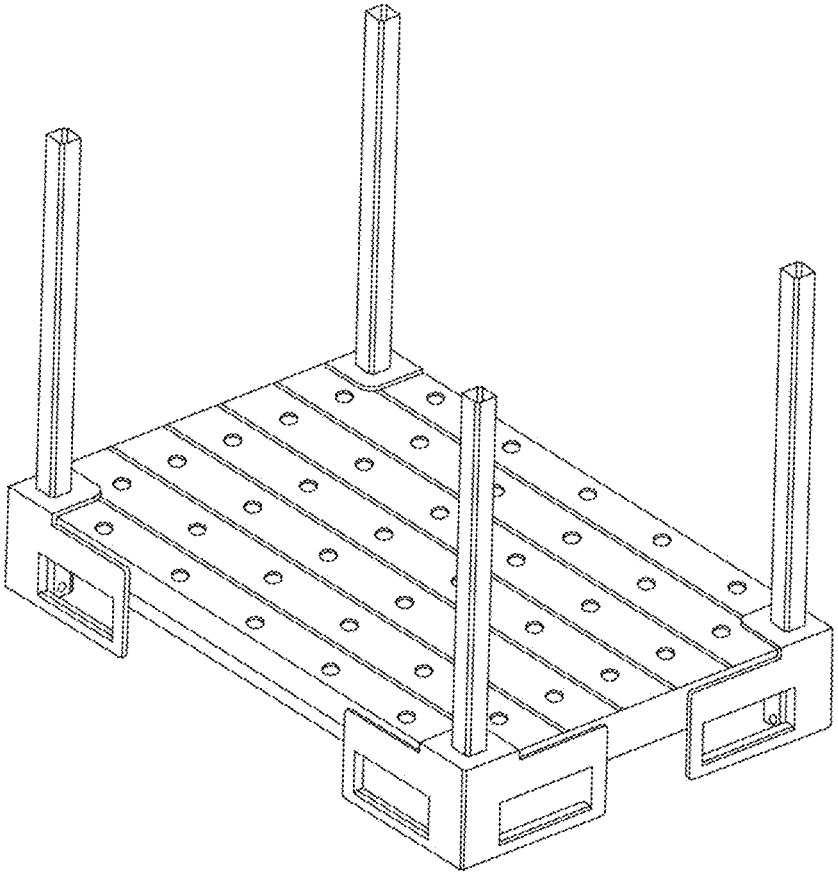
FIG. 29 is schematic diagram of fixing pallet protection feet on multiple sides by using the upright columns at the four corners.
Figure 30:
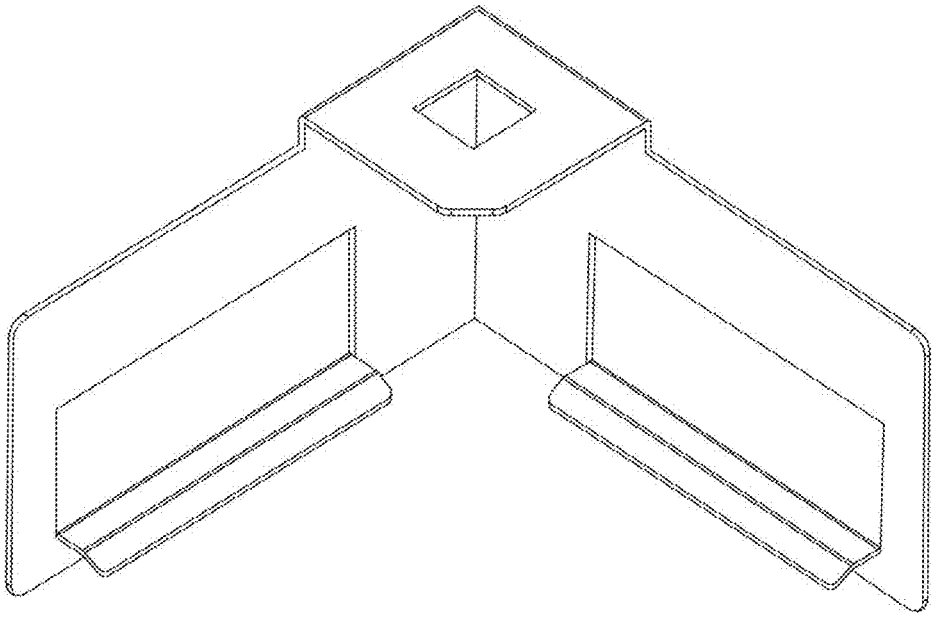
FIG. 30 is a schematic diagram of a pallet protection foot in a form III in FIG. 29.
Figure 31:
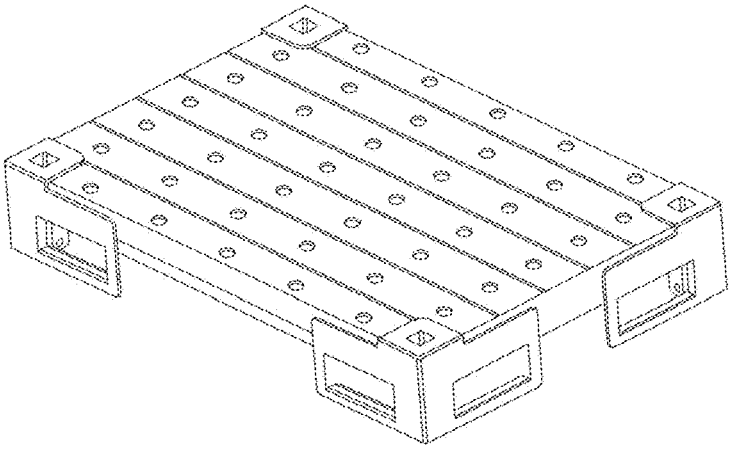
FIG. 31 is a schematic diagram of mounting the pallet protection feet on a periphery of the pallet when holes at the four corners of the pallet are not occupied and the upright columns at the four corners are not required.
Figure 32:
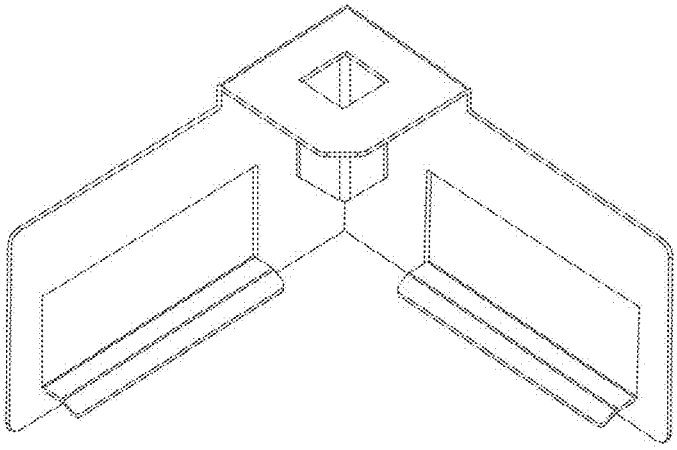
FIG. 32 is a schematic diagram of a pallet protection foot in a form IV in FIG. 31.

FIGS. 26 to 28 show a pallet protection foot in form II, and the pallet protection feet may be fixed by using upright columns at four corners; FIGS. 29 and 30 show a pallet protection foot in form III, and the pallet protection feet on multiple sides are fixed by using upright columns at the four corners; and FIGS. 31 and 32 show a pallet protection foot in form IV, and when the holes at the four corners of the pallet are not occupied and the upright columns at the four corners are not required, the pallet protection feet around the pallet may be mounted in the manner shown in FIGS. 31 and 32.

Embodiment VII

Figure 33:
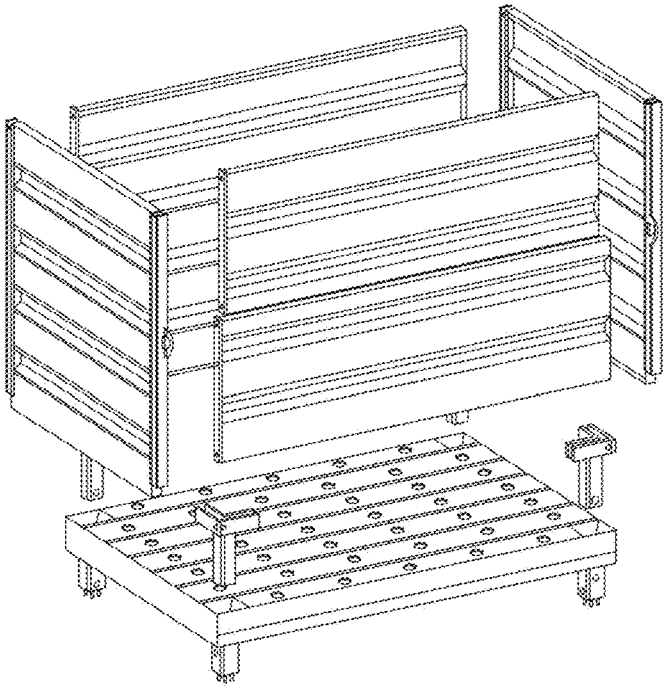
FIG. 33 is a split diagram of the pallet main body, fence fixing feet, detachable fences in embodiment 7.
Figure 34:
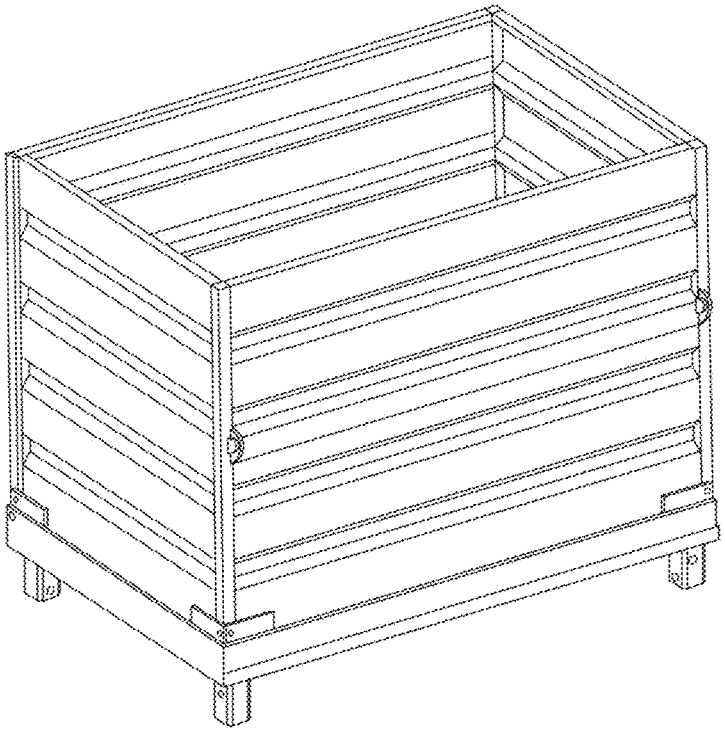
FIG. 34 is a schematic diagram of a box body pallet assembled by the pallet main body, the fence fixing feet, and the detachable fences in embodiment 7.
Figure 35:
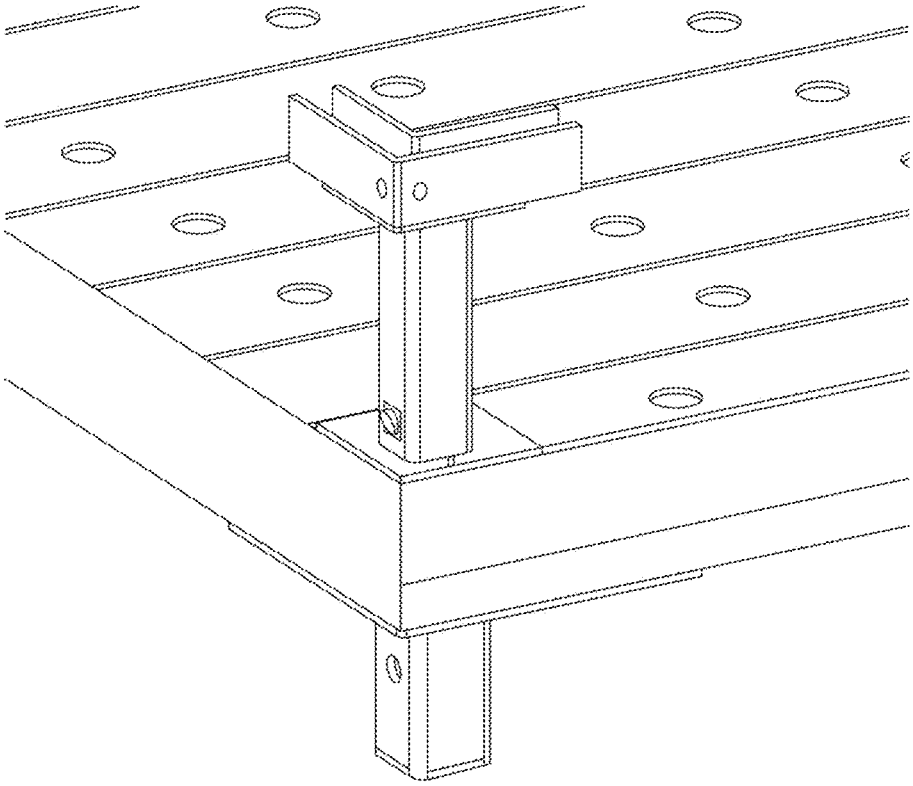
FIG. 35 is a schematic diagram of a mounting manner of the fence fixing feet.

As shown in FIGS. 33 to 35, pallet fences are also arranged on the periphery of the pallet main body in the present embodiment. Fence fixing feet and detachable fences may be assembled in a box body pallet form by using special bearing structures of the support legs at the four corners of the pallet. The fence fixing feet may also be replaced by inserting square pipes into "special bearing structures of the support legs at the four corners of the pallet" to form a carrier for connecting the detachable fences, so as to implement a pallet stacking solution. As shown in FIG. 35, the fence fixing feet fix the detachable fences through bolts or pins, and assembling and disassembling processes are simple and quick.

Embodiment VIII

Figure 36:
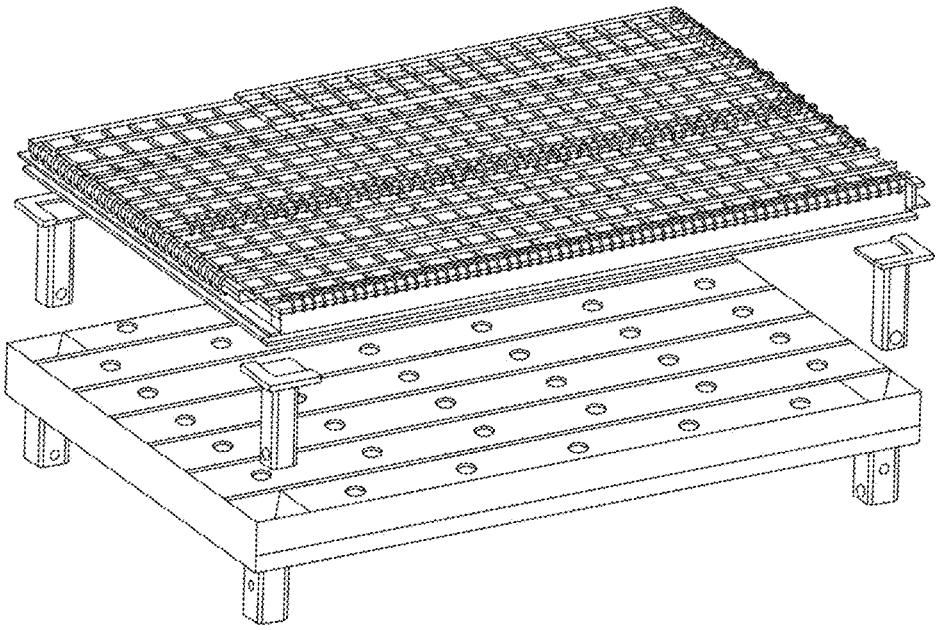
FIG. 36 is a split diagram of the pallet main body, fence net fixing feet, detachable fence nets in embodiment 8.
Figure 37:
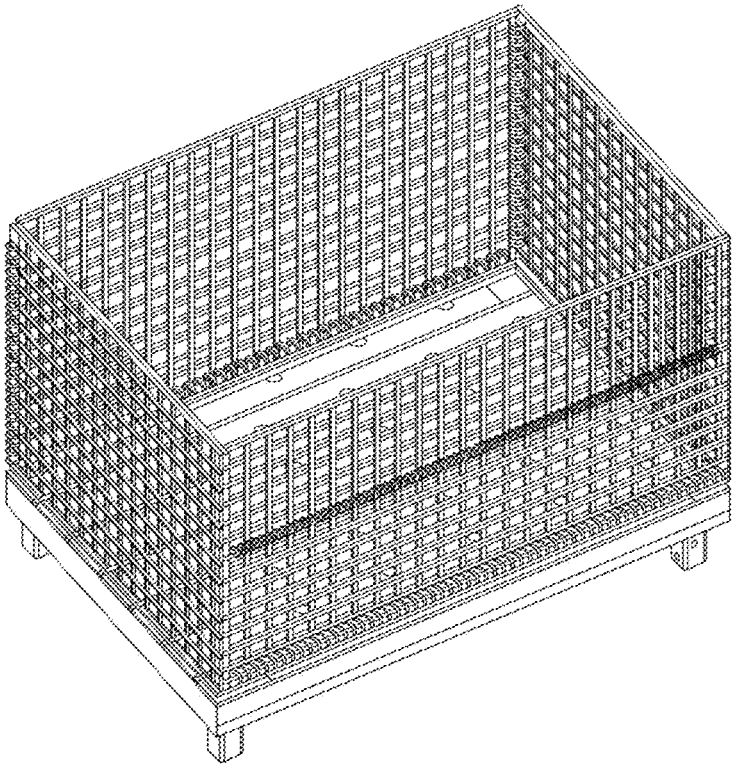
FIG. 37 is a schematic diagram of a box body pallet assembled by the pallet main body, the fence net fixing feet, the detachable fence nets in embodiment 8.
Figure 38:
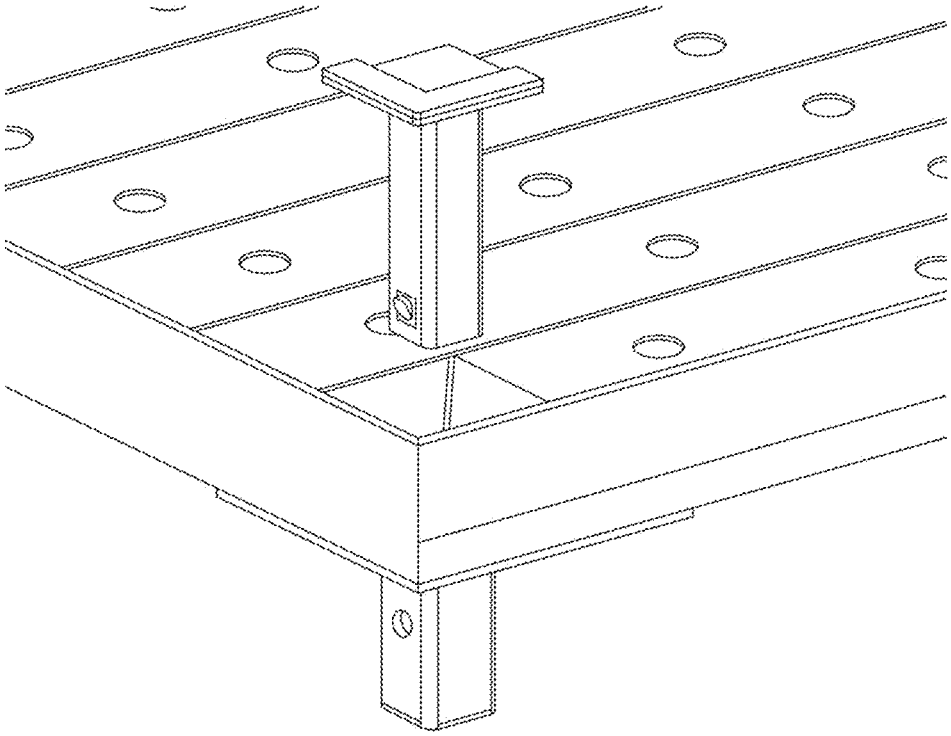
FIG. 38 is a schematic diagram of a mounting manner of the fence net fixing feet.

As shown in FIGS. 36 to 38, pallet fences are also arranged on the periphery of the pallet main body in the present embodiment. Fence net fixing feet and foldable fence nets may be assembled into a folding grille box pallet by using special bearing structures of the support legs at the four corners of the pallet. The fence net fixing feet may also be replaced by inserting square pipes into "special bearing structures of the support legs at the four corners of the pallet" to form a carrier for connecting the detachable fence nets, so as to implement a pallet stacking solution. As shown in FIG. 38, the fence net fixing feet are fixed to pallet feet by bolts or pins, assembling and disassembling processes are simple and quick, and a small storage area is small after the foldable fences are detached.

Specific embodiments described herein are merely illustrative examples of the spirit of the present disclosure. Those skilled in the art of the present disclosure can make various modifications or supplements to the described specific embodiments or replace the described specific embodiments in similar manners, but will not deviate from the spirit of the present disclosure or beyond the scope defined in the appended claims.

Although terms such as pallet main body 1, peripheral plate 11, top plate 12, bottom plate 13, triangular plate 14, fixed base plate 15, protective base plate 16, support leg 2, main guide port 21, universal roller 22, cart rod 23, handrail 24, handrail base 25, storage mechanism 3, support pipe 31, support hole 32, support rod 33, first limiting component 4, gasket 41, second limiting component 5, limiting cross rod 51, main base 52, limiting longitudinal rod 53, auxiliary base 54, third limiting component 6, upright rod 61, shelf cross rod 62, main rod seat 63, shelf longitudinal rod 64, auxiliary rod seat 65, shelf base 66, and auxiliary guide port 67 are used extensively, it does not rule out the possibility of applying other terms. The apply of these terms is only for facilitating describing and explaining the essence of the present disclosure. Interpreting these terms as any additional limitation is contrary to the spirit of the present disclosure.

It is to be noted that, for those skilled in the art, apparently, the present disclosure is not limited to the details of the above exemplary embodiments, and can be implemented in other specific forms without departing from the spirit or basic features of the present disclosure. Therefore, from any point of view, the embodiments are to be regarded as exemplary but not restrictive. The scope of the present disclosure is limited by the attached claims rather than the above description. Therefore, it is intended to include all changes within the meaning and scope of the equivalent elements of the claims in the present disclosure, and any drawing reference signs in the claims are not to be regarded as limiting the claims involved.

In the present disclosure, specific examples are applied to illustrate the principle and the implementations of the present disclosure. The description of the above embodiments is only used to help understand the method and core idea of the present disclosure. Meanwhile, for those of ordinary skill in the art, there will be changes in specific implementations and application scopes according to the idea of the present disclosure. In conclusion, the content of the present specification is not to be construed as a limitation to the present disclosure.

What is claimed is:

1. A composite multi-functional load-bearing pallet, comprising:

a pallet main body, wherein the pallet main body comprises peripheral plates, top plates, and bottom plates, the peripheral plates are connected and fixed in sequence in an end to end manner to form a frame of the pallet main body, the bottom plates and the top plates are mounted on an inner side of the frame formed by the peripheral plates from bottom to top, and a plurality of support holes are formed in the top plates;

support legs, wherein the support legs are respectively arranged at corners of the pallet main body, each of the support legs comprises a main guide port and a support body that are connected integrally, an opening of the main guide port is upward and is positioned at a corner of the pallet main body, a bottom of the main guide port is communicated with the support body, and a bottom of the support body is closed through a cover plate, and the main guide port is funnel-shaped;

a storage mechanism, wherein the storage mechanism for limiting and storing cargoes is arranged on the pallet main body, the storage mechanism comprises support pipes and support rods, each of the support pipes is detachably inserted at the main guide port, and each of the support rods is detachably inserted in a corresponding one of the plurality of support holes; and a limiting mechanism, wherein the limiting mechanism is configured to limit a relative orientation of two adjacent pallet main bodies.

2. The composite multi-functional load-bearing pallet according to claim 1, wherein a plurality of top plates are laid side by side in the frame formed by the peripheral plates; a plurality of support holes are formed in each of the plurality of top plates; all of the plurality of top plates are in a same specification, and the support holes are in one-to-one correspondence in position.

3. The composite multi-functional load-bearing pallet according to claim 2, wherein the top plates and the bottom plates are all C-shaped plates; a plurality of vertical cylinders are equidistantly distributed between the top plates and the bottom plates; and the plurality of vertical cylinders and the plurality of support holes are in one-to-one correspondence in position and are communicated with each other.

4. The composite multi-functional load-bearing pallet according to claim 1, wherein the main guide port is formed by splicing and welding four pieces of trapezoidal plates; the main guide port is configured to guide one of the support pipes or one of the support legs to be inserted; an upper port of the main guide port is flush with the top plates of the pallet main body; and the support body is made of a rectangular pipe arranged vertically.

5. The composite multi-functional load-bearing pallet according to claim 1, wherein a triangular plate for the support body to penetrate through is fixed to each of corners of a bottom surface of the pallet main body; and when two pallet main bodies are extended continuously, sides of the two pallet main bodies at corresponding support legs at bottom surfaces of the two pallet main bodies are connected by welding, and the triangular plates at the corresponding support legs at bottom surfaces of the two pallet main bodies are connected by welding.

6. The composite multi-functional load-bearing pallet according to claim 1, wherein a universal wheel is mounted at a bottom of each of the support legs; two cart rods are inserted in upper ends of two adjacent support legs; and the two cart rods are connected to each other through a handrail.

7. The composite multi-functional load-bearing pallet according to claim 1, wherein the limiting mechanism comprises a first limiting component; the first limiting component comprises a gasket fixed to a lower end of the support body; a notch for clamping the cover plate is reserved in the bottom of the support body; the gasket is fixed to a bottom of the cover plate; and the gasket is embedded in the main guide port of a lower pallet.

8. The composite multi-functional load-bearing pallet according to claim 1, wherein the limiting mechanism comprises a second limiting component; the second limiting component comprises two limiting cross rods, main bases, limiting longitudinal rods, and auxiliary bases; the two limiting cross rods are arranged in parallel at bottoms of short sides of the pallet main body; a bottom of each of the support legs at a corresponding one of the corners of the pallet main body is inserted and fixed to a corresponding one of the main bases on a corresponding one of the two limiting cross rods; two ends of the two limiting cross rods are respectively connected through the limiting longitudinal rods; and each of the two limiting cross rods is fixed inside a corresponding one of the auxiliary bases on a corresponding one of the limiting longitudinal rods.

9. The composite multi-functional load-bearing pallet according to claim 1, wherein the limiting mechanism comprises a third limiting component; the third limiting component comprises upright rods, two shelf cross rods, and shelf longitudinal rods; a bottom end of each of the upright rods is inserted in the main guide port; the two shelf cross rods are arranged in parallel at tops of short sides of the pallet main body; a top end of each of the upright rods is inserted and fixed inside a main rod seat on a corresponding one of the two shelf cross rods; two ends of the two shelf cross rods are respectively connected through the shelf longitudinal rods; an auxiliary rod seat for inserting the main rod seat is arranged on a corresponding one of the shelf longitudinal rods; a shelf base is inserted and fixed to an upper end of the auxiliary rod seat; and an upper end of the shelf base has a funnel-shaped auxiliary guide port for a corresponding one of the support legs of an upper pallet to insert.

* * * * *